US012339031B1

(12) United States Patent
Tang et al.

(10) Patent No.: US 12,339,031 B1
(45) **Date of Patent: *Jun. 24, 2025**

(54) AIR CONDITIONER

(71) Applicant: HISENSE (GUANGDONG) AIR CONDITIONING CO., LTD., Guangdong (CN)

(72) Inventors: Wei Tang, Guangdong (CN); Dechuang Yuan, Guangdong (CN); Zhiwen Liang, Guangdong (CN); Hongjie Chen, Guangdong (CN)

(73) Assignee: HISENSE (GUANGDONG) AIR CONDITIONING CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 19/073,218

(22) Filed: Mar. 7, 2025

Related U.S. Application Data

(63) Continuation of application No. 17/897,601, filed on Aug. 29, 2022, now Pat. No. 12,276,435.

(30) Foreign Application Priority Data

| | | |
|---|---|---|
| Nov. 29, 2021 | (CN) | 202122958997.X |
| Nov. 29, 2021 | (CN) | 202122963652.3 |
| Nov. 29, 2021 | (CN) | 202122963875.X |
| Nov. 29, 2021 | (CN) | 202122964180.3 |
| Nov. 29, 2021 | (CN) | 202122964250.5 |

(51) Int. Cl.
*F24F 13/20* (2006.01)
*F24F 11/63* (2018.01)

(52) U.S. Cl.
CPC ..... *F24F 13/20* (2013.01); *F24F 11/63* (2018.01); *F24F 2013/207* (2013.01)

(58) Field of Classification Search
CPC ..... F24F 13/20; F24F 11/63; F24F 2013/207
See application file for complete search history.

(56) References Cited

FOREIGN PATENT DOCUMENTS

CN 113280408 A * 8/2021

* cited by examiner

*Primary Examiner* — Ana M Vazquez
(74) *Attorney, Agent, or Firm* — Hodgson Russ LLP

(57) ABSTRACT

An air conditioner includes a base, a housing, an indoor unit, an outdoor unit and an electrical control assembly. The housing is disposed on the base, and an accommodating space is provided between the housing and the base. The indoor unit is located in the accommodating space. The outdoor unit is located in the accommodating space and arranged at an interval with the indoor unit. At least one of sides of the indoor unit and the outdoor unit proximate to each other is provided with a groove. The electrical control assembly is installed between the indoor unit and the outdoor air unit, and at least a part of the electrical control assembly is installed in the groove. The electrical box of the electrical control component includes a cover and an accommodation portion, both of which have connecting portions that extend into the groove and are connected to the groove.

21 Claims, 19 Drawing Sheets

AIR CONDITIONER

CROSS-REFERENCE TO RELATED APPLICATIONS

This application is a continuation of U.S. patent application Ser. No. 17/897,601, filed on Aug. 29, 2022, which claims priority to Chinese Patent Application No. 202122958997.X, filed on Nov. 29, 2021; Chinese Patent application No. 202122964250.5, filed on Nov. 29, 2021; Chinese Patent application No. 202122964180.3, filed on Nov. 29, 2021; Chinese Patent application No. 202122963652.3, filed on Nov. 29, 2021; and Chinese Patent application No. 202122963875.X, filed on Nov. 29, 2021. The entire disclosures of the above-identified applications are hereby incorporated herein by reference.

TECHNICAL FIELD

The present disclosure relates to the field of air conditioning technologies, and in particular, to an air conditioner.

BACKGROUND

A window air conditioner is a small air conditioner installed in a window. A part of the window air conditioner is located indoors, and another part of the window air conditioner is located outdoors. The part of the window air conditioner that is located indoors is an indoor unit, and the another part of the window air conditioner that is located outdoors is an outdoor unit. The indoor unit exchanges heat with indoor air, and the outdoor unit exchanges heat with outdoor air, so as to realize cooling and heating of the window air conditioner.

SUMMARY

In some embodiments of the present disclosure, an air conditioner is provided. The air conditioner includes:

a base;

a housing disposed on the base, an accommodating space being provided between the housing and the base;

an indoor unit located in the accommodating space;

an outdoor unit located in the accommodating space and arranged at an interval with the indoor unit; wherein at least one of sides of the indoor unit and the outdoor unit proximate to each other is provided with a groove; and an electrical control assembly installed between the indoor air unit and the outdoor air unit, at least a part of the electrical control assembly being installed in the groove;

wherein the electrical control assembly includes:

an electrical box comprising a cover and an accommodating portion, wherein the cover covers the accommodating portion to form an internal space for accommodating the controller, and each of the cover and the accommodating portion has a connecting portion on a side corresponding to the groove, wherein the connecting portions of the cover and the accommodating portion extend to the groove and are connected to the groove; and a controller disposed in the electrical box.

DETAILED DESCRIPTION

Figure 1A:
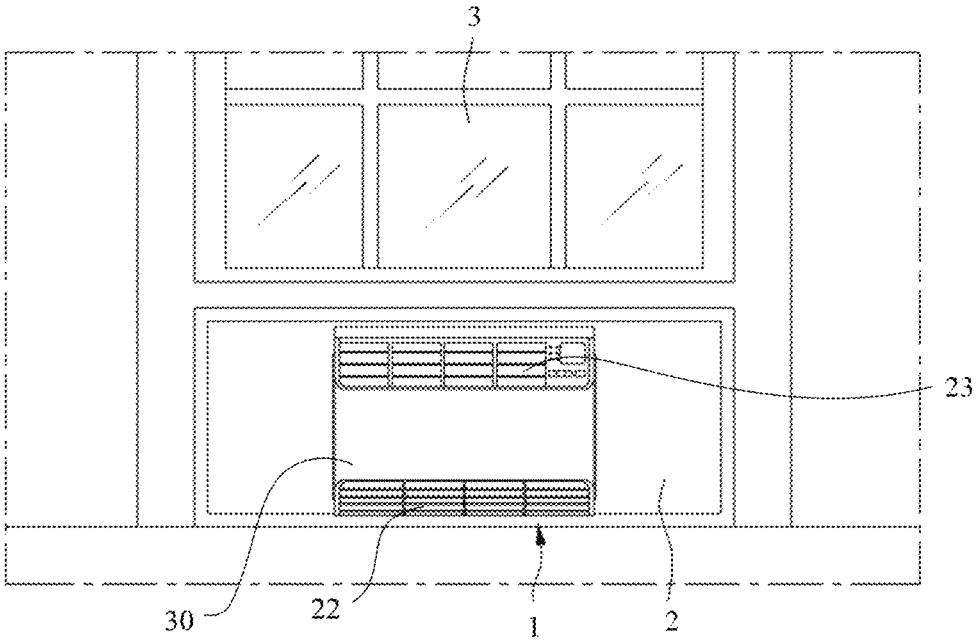
FIG. 1A is a diagram showing a structure of an air conditioner installed in a wall, in accordance with some embodiments.

Some embodiments of the present disclosure will be described clearly and completely with reference to the accompanying drawings below. However, the described embodiments are merely some but not all embodiments of the present disclosure. All other embodiments obtained by a person of ordinary skill in the art based on the embodiments of the present disclosure shall be included in the protection scope of the present disclosure.

Unless indicated otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, terms such as "first" and "second" are used for descriptive purposes only, and are not to be construed as indicating or implying the relative importance or implicitly indicating the number of indicated technical features. Thus, features defined by "first" or "second" may explicitly or implicitly include one or more of the features. In the description of the embodiments of the present disclosure, unless otherwise specified, the term "a/the plurality of" means two or more.

In the description of some embodiments, the expressions "connected" and its derivatives may be used. For example, the term "connected" may be used in the description of some embodiments to indicate that two or more components are in direct physical or electrical contact with each other. The embodiments disclosed herein are not necessarily limited to the contents herein.

The use of the phrase "applicable to" or "configured to" herein means an open and inclusive expression, which does not exclude apparatuses that are applicable to or configured to perform additional tasks or steps.

The term such as "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., limitations of a measurement system).

A side of an air conditioner 1 facing a user during it is being used is defined as a front side, and a side opposite to the front side is defined as a rear side.

Air Conditioner

Figure 1B:
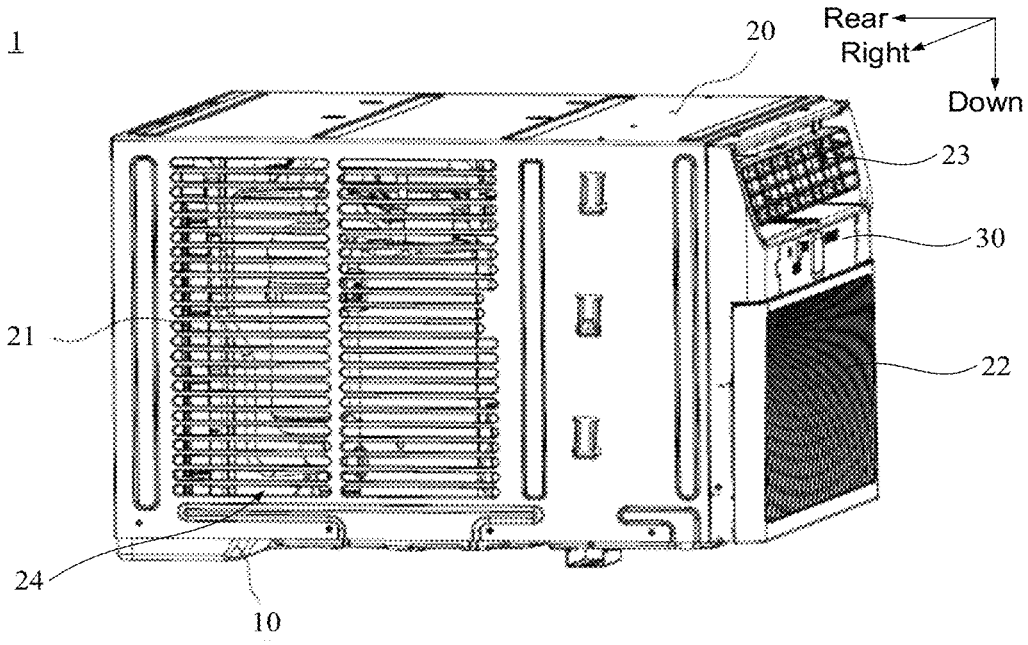
FIG. 1B is a diagram showing a structure of an air conditioner, in accordance with some embodiments.
Figure 2:
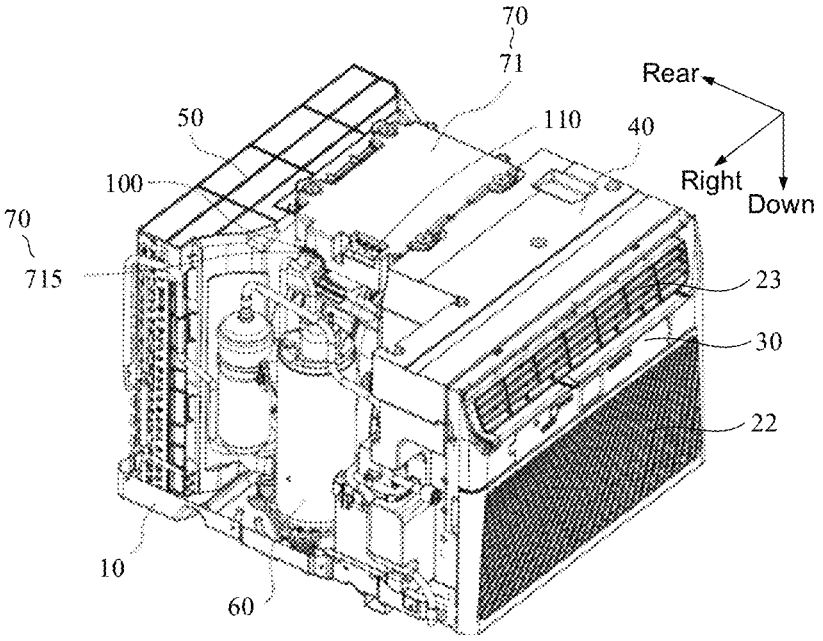
FIG. 2 is a diagram showing an internal structure of an air conditioner with a housing being removed, in accordance with some embodiments.
Figure 3:
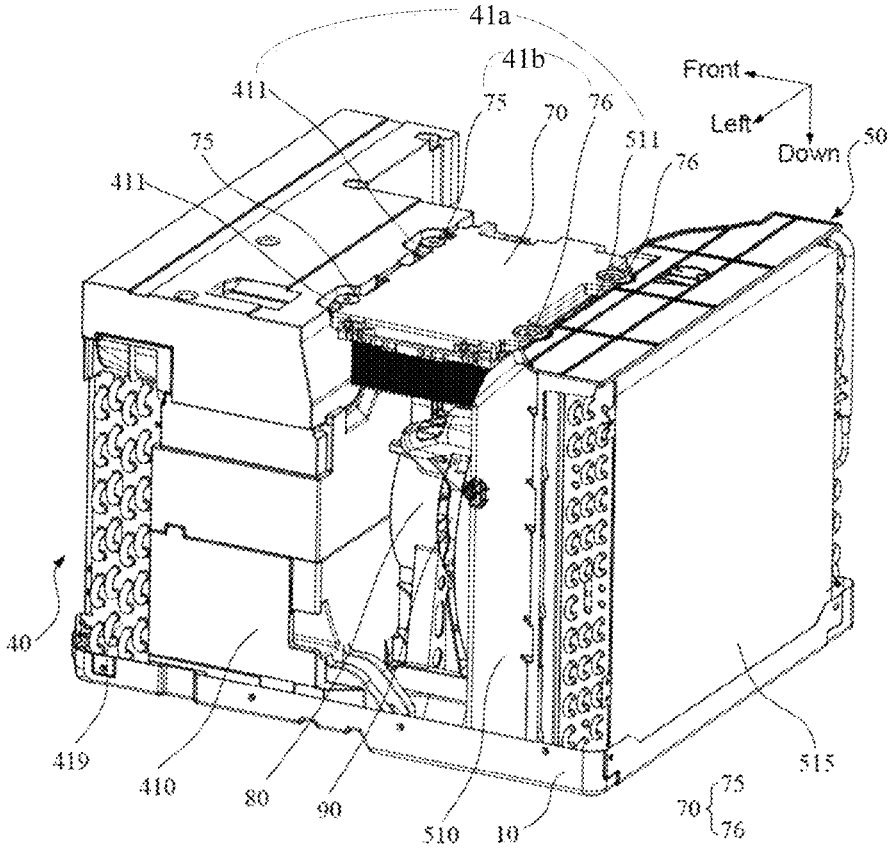
FIG. 3 is a diagram showing an internal structure of an air conditioner with a housing and a panel assembly being removed, in accordance with some embodiments.

FIG. 1A is a diagram showing a structure of an air conditioner installed in a wall, in accordance with some embodiments. FIG. 1B is a diagram showing a structure of an air conditioner, in accordance with some embodiments. FIG. 2 is a diagram showing an internal structure of an air conditioner with a housing being removed, in accordance with some embodiments. FIG. 3 is a diagram showing an internal structure of an air conditioner with a housing and a panel assembly being removed, in accordance with some embodiments.

In some embodiments of the present disclosure, an air conditioner 1 is provided. The air conditioner 1 is a window air conditioner. The window air conditioner may be installed in a wall 2 or a window 3 of a building such as a residential building. For example, as shown in FIG. 1A, there is a space reserved in the wall 2 of the building for installing the air conditioner 1. The air conditioner 1 may be embedded in the space, and a first part of the air conditioner 1 is located indoors, and a second part of the air conditioner 1 is located outdoors.

As shown in FIGS. 1B to 3, the air conditioner 1 includes a base 10, a housing 20, a panel assembly 30, an indoor unit 40 and an outdoor unit 50.

Housing

As shown in FIG. 1B, the housing 20 is covered on the base 10 and connected to the panel assembly 30. The panel assembly 30 is disposed on the base 10 and is located on a side (e.g., the front side as shown in FIG. 2) of the indoor unit 40 away from the outdoor unit 50. An accommodating space 24 is provided between the base 10 and the housing 20.

In some embodiments, as shown in FIG. 1B, the air conditioner 1 further includes an outdoor air inlet 21, an indoor air inlet 22 and an indoor air outlet 23. The outdoor air inlet 21, the indoor air inlet 22 and the indoor air outlet 23 are all communicated to the accommodating space 24. Both sides (e.g., the left and right sides as shown in FIG. 1B) of the housing 20 in a width direction thereof are provided with the outdoor air inlet 21. The indoor air inlet 22 and the indoor air outlet 23 are arranged on the panel assembly 30 at an interval, and the indoor air outlet 23 is further away from the base 10 than the indoor air inlet 22. For example, the indoor air outlet 23 is located above the indoor air inlet 22.

Indoor Unit

As shown in FIG. 2, the indoor unit 40 is located in the accommodating space 24, and the indoor unit 40 is proximate to the indoor air inlet 22. For example, the indoor unit 40 is installed on the base 10 or installed on the housing 20. As shown in FIG. 3, the indoor unit 40 includes an indoor air duct component 410, an indoor heat exchange air duct 417 (as shown in FIG. 4B) and an indoor heat exchanger 419.

The indoor heat exchange air duct 417 is disposed in the indoor air duct component 410. The indoor heat exchanger 419 is located on a side of the indoor air duct component 410 away from the outdoor unit 50, and the indoor heat exchanger 419 is configured to perform heat exchange between indoor air and a refrigerant transmitted in the indoor heat exchanger 419. For example, the indoor heat exchanger 419 operates as an evaporator in a cooling mode of the air conditioner 1, and operates as a condenser in a heating mode of the air conditioner 1.

Figure 4A:
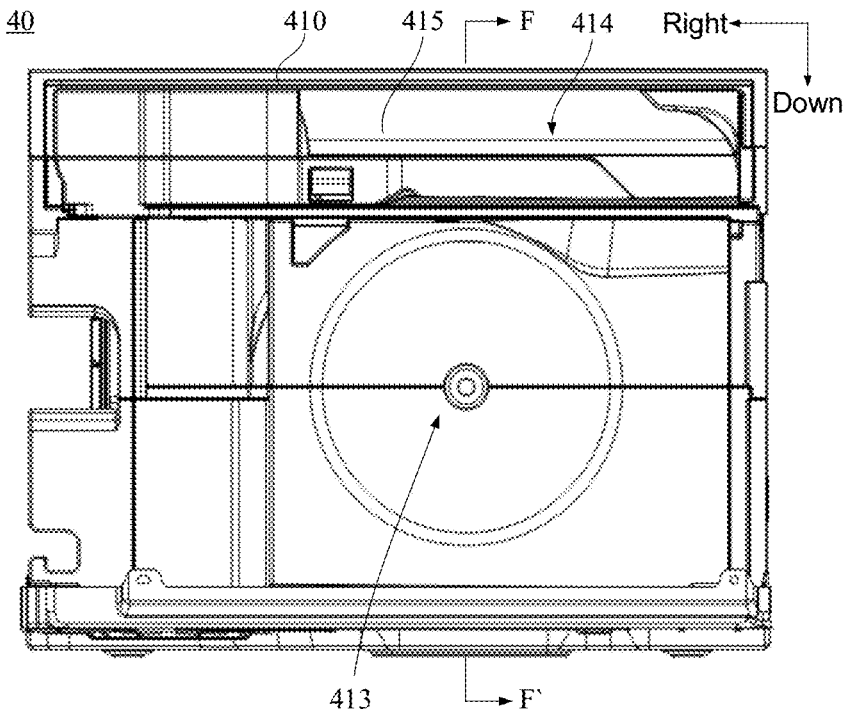
FIG. 4A is a front view of an indoor unit in an air conditioner, in accordance with some embodiments.

FIG. 4A is a front view of an indoor unit in an air conditioner, in accordance with some embodiments. FIG. 4B is a sectional view taken along the line FF' in FIG. 4A.

Figure 4B:
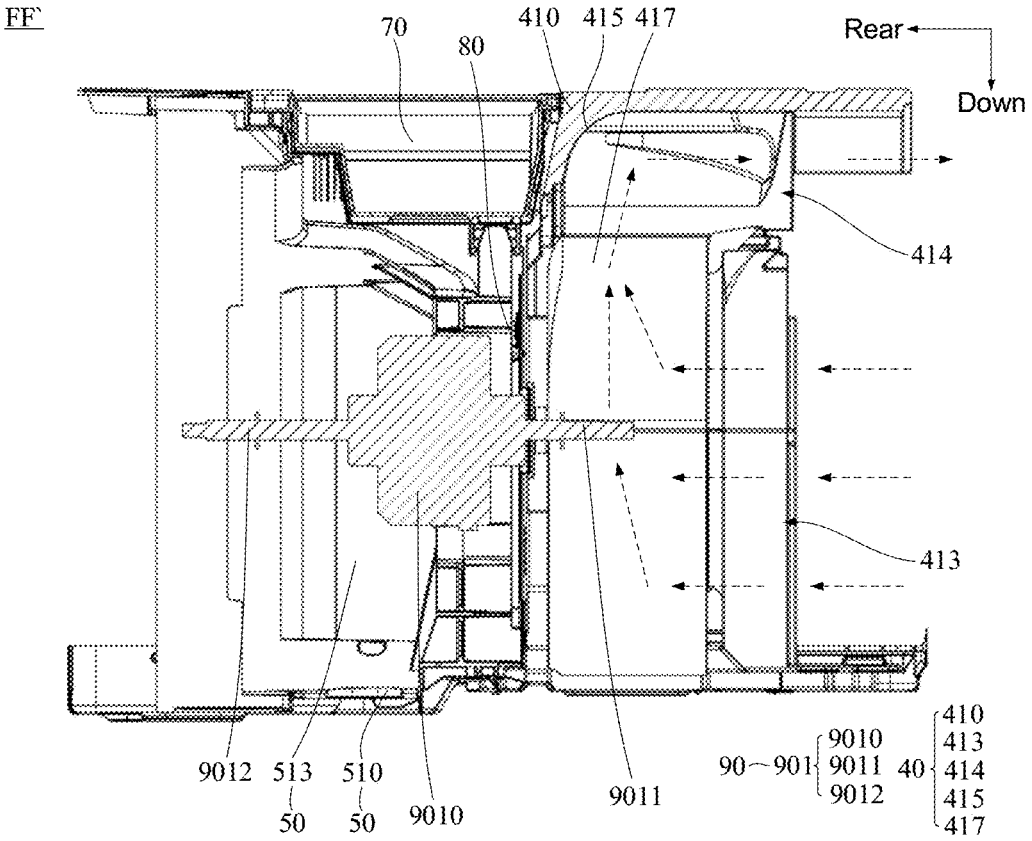
FIG. 4B is a sectional view taken along the line FF' in FIG. 4A.

In some embodiments, as shown in FIGS. 4A and 4B, the indoor unit 40 includes an air inlet 413, an air outlet 414 and a guide surface 415. The air inlet 413 and the air outlet 414 are both located on a side (e.g., the front side) of the indoor air duct component 410 away from the outdoor unit 50, and the air inlet 413 and the air outlet 414 both communicate with the indoor heat exchange air duct 417. Moreover, the air inlet 413 further communicates with the indoor air inlet 22, and the air outlet 414 further communicates with the indoor air outlet 23. For example, in a flow direction (e.g., the direction indicated by the dashed arrows as shown in FIG. 4B) of indoor air, the air inlet 413 is located on a downstream side of the indoor air inlet 22, and the air outlet 414 is located on an upstream side of the indoor air outlet 23. The guide surface 415 is a part of an inner wall surface of the indoor air duct component 410, and located in the indoor heat exchange air duct 417. The guide surface 415 is configured to guide indoor air from the air inlet 413 to the air outlet 414. In some examples, the guide surface 415 may be in a shape of an arc, so as to reduce the resistance to indoor air.

Since the air inlet 413 and the air outlet 414 both are located on the front side of the indoor air duct component 410, it is necessary for indoor air to change the flow direction so as to flow out from the air outlet 414 and the indoor air outlet 23, after indoor air enters the indoor heat exchange air duct 417 through the indoor air inlet 22 and the air inlet 413 in sequence. By providing the guide surface 415 in the indoor heat exchange air duct 417, it is possible to avoid the collision between indoor air and an inner wall of the indoor heat exchange air duct 417 when the flow direction of indoor air suddenly changes, so that the resistance for indoor air to flow is reduced, and the flow of indoor air is smooth.

Outdoor Unit

As shown in FIG. 3, the outdoor unit 50 is located in the accommodating space 24, and the outdoor unit 50 is arranged at an interval on a side (e.g., the rear side as shown in FIG. 2) of the indoor unit 40 away from the indoor air inlet 22. For example, the outdoor unit 50 is installed on the base 10 or installed on the housing 20. The outdoor air inlet 21 communicates with a space between the outdoor unit 50 and the indoor unit 40.

The outdoor unit 50 includes an outdoor air duct component 510, an outdoor heat exchange air duct 513 (as shown in FIG. 4B) and an outdoor heat exchanger 515. The outdoor heat exchange air duct 513 is disposed in the outdoor air duct component 510, and the outdoor heat exchange air duct 513 communicates with the space between the outdoor unit 50 and the indoor unit 40. The outdoor heat exchanger 515 is located on a side (e.g., the rear side) of the outdoor air duct component 510 away from the indoor air duct component 410, and the outdoor heat exchanger 515 is configured to perform heat exchange between outdoor air and the refrigerant transmitted in the outdoor heat exchanger 515. For example, the outdoor heat exchanger 515 operates as a condenser in the cooling mode of the air conditioner 1, and operates as an evaporator in the heating mode of the air conditioner 1.

After entering the accommodating space 24 through the outdoor air inlet 21, outdoor air enters the outdoor heat exchange air duct 513 through the space between the outdoor unit 50 and the indoor unit 40, and flows to the outdoor heat exchanger 515 through the outdoor heat exchange air duct 513. Outdoor air flows to the outdoors after exchanging heat with the outdoor heat exchanger 515.

Compressor

In some embodiments, as shown in FIG. 2, the air conditioner 1 further includes a compressor 60 located in the accommodating space 24. For example, the compressor 60 is installed on the base 10 or installed on the indoor unit 40 or the outdoor unit 50. The compressor 60 is disposed between the indoor unit 40 and the outdoor unit 50, and located on a side of the base 10 in the width direction (e.g., the left-right direction), and provided proximate to the outdoor air inlet 21.

Fan Assembly

In some embodiments, as shown in FIG. 3, the air conditioner 1 further includes a fan assembly 90.

As shown in FIG. 3, the fan assembly 90 is disposed between the indoor unit 40 and the outdoor unit 50, and the fan assembly 90 is configured to drive indoor air and outdoor air to flow, so that the air conditioner 1 may perform heat exchange, as a result, cooling or heating to indoor environment is realized.

Figure 5:
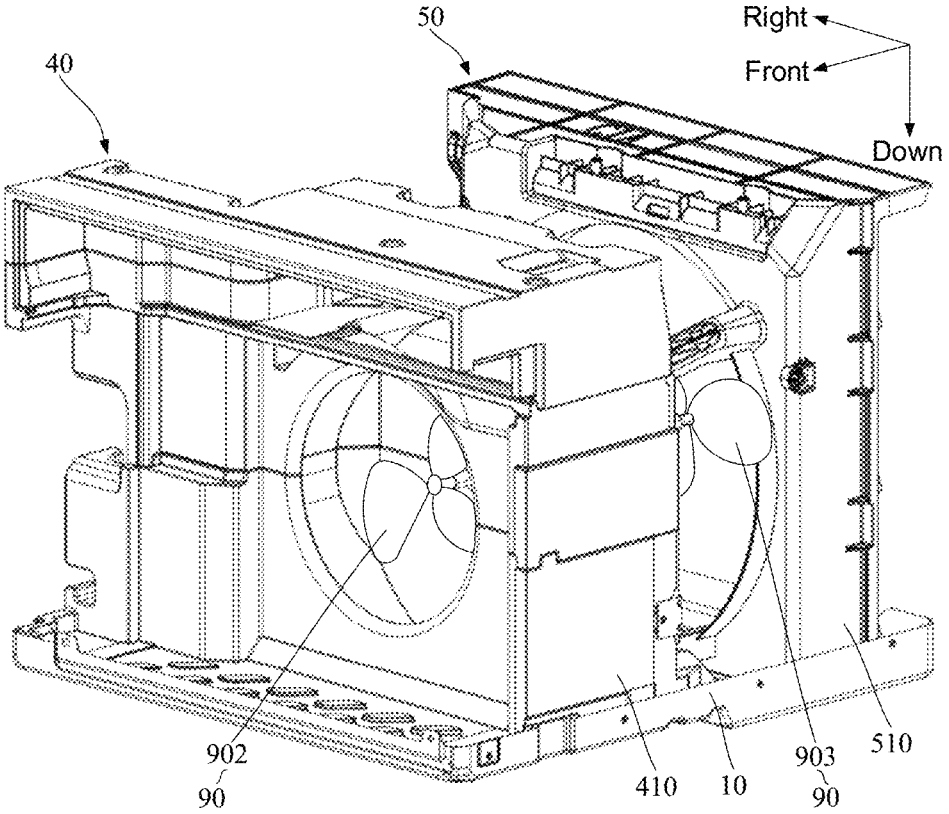
FIG. 5 is a diagram showing a structure of an indoor unit, an outdoor unit and a fan assembly in an air conditioner, in accordance with some embodiments.

For example, FIG. 5 is a diagram showing a structure of an indoor unit, an outdoor unit and a fan assembly in an air conditioner, in accordance with some embodiments. As shown in FIGS. 4B and 5, the fan assembly 90 includes a motor assembly 901, a first fan 902 and a second fan 903. The first fan 902 and the second fan 903 are respectively connected to output shafts at both ends of the motor assembly 901. For example, as shown in FIG. 4B, the motor assembly 901 includes a motor 9010, a first output shaft 9011 and a second output shaft 9012. An end of the first output shaft 9011 is rotatably connected to the motor 9010, and another end of the first output shaft 9011 is located in the indoor air duct component 410 and connected to the first fan 902. An end of the second output shaft 9012 is rotatably connected to the motor 9010, and another end of the second output shaft 9012 is located in the outdoor air duct component 510 and connected to the second fan 903. The motor 9010 is configured to drive the first output shaft 9011 and the second output shaft 9012.

It will be noted that, the first output shaft 9011 and the second output shaft 9012 may rotate synchronously, or may rotate independently, and the present disclosure is not limited thereto.

Electrical Control Assembly

In some embodiments, as shown in FIG. 2, the air conditioner 1 further includes an electrical control assembly 70. The electrical control assembly 70 is disposed in the accommodating space 24 and installed between the indoor unit 40 and the outdoor unit 50. Moreover, the electrical control assembly 70 is arranged at an interval with the compressor 60, and proximate to the outdoor air inlet 21. For example, the electrical control assembly 70 is installed between the indoor air duct component 410 and the outdoor air duct component 510, and the electrical control assembly 70 is located above the compressor 60. Alternatively, the electrical control assembly 70 is located on a left side of the compressor 60.

In some embodiments, the electrical control assembly 70 is connected to ends (e.g., the top ends) of the indoor unit 40 and the outdoor unit 50 away from the base 10. In this way, the electrical control assembly 70 is arranged at an interval with the base 10 and the compressor 60, which facilitates the heat dissipation of the electrical control assembly 70.

Figure 6:
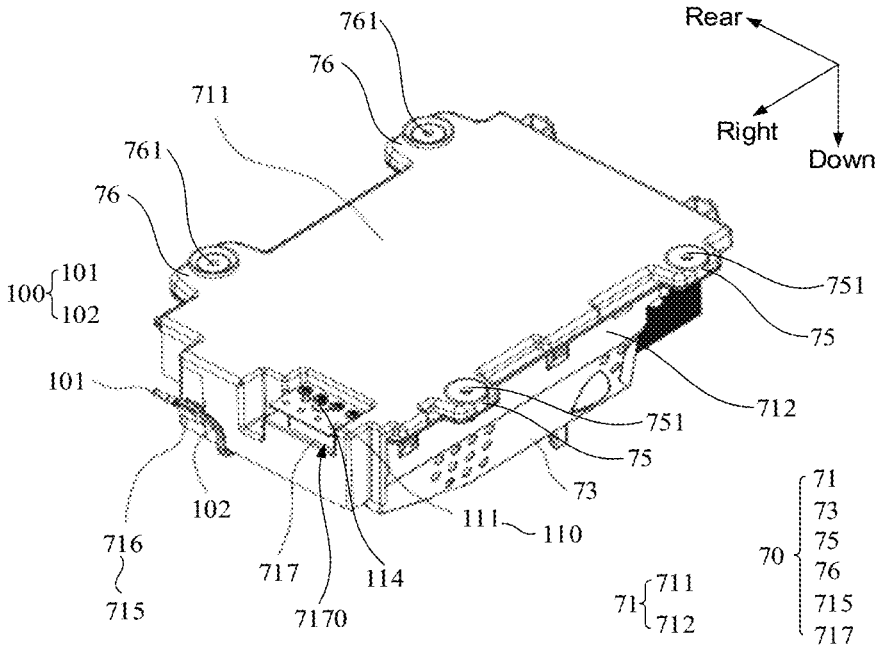
FIG. 6 is a diagram showing a structure of an electrical control assembly in an air conditioner, in accordance with some embodiments.
Figure 7:
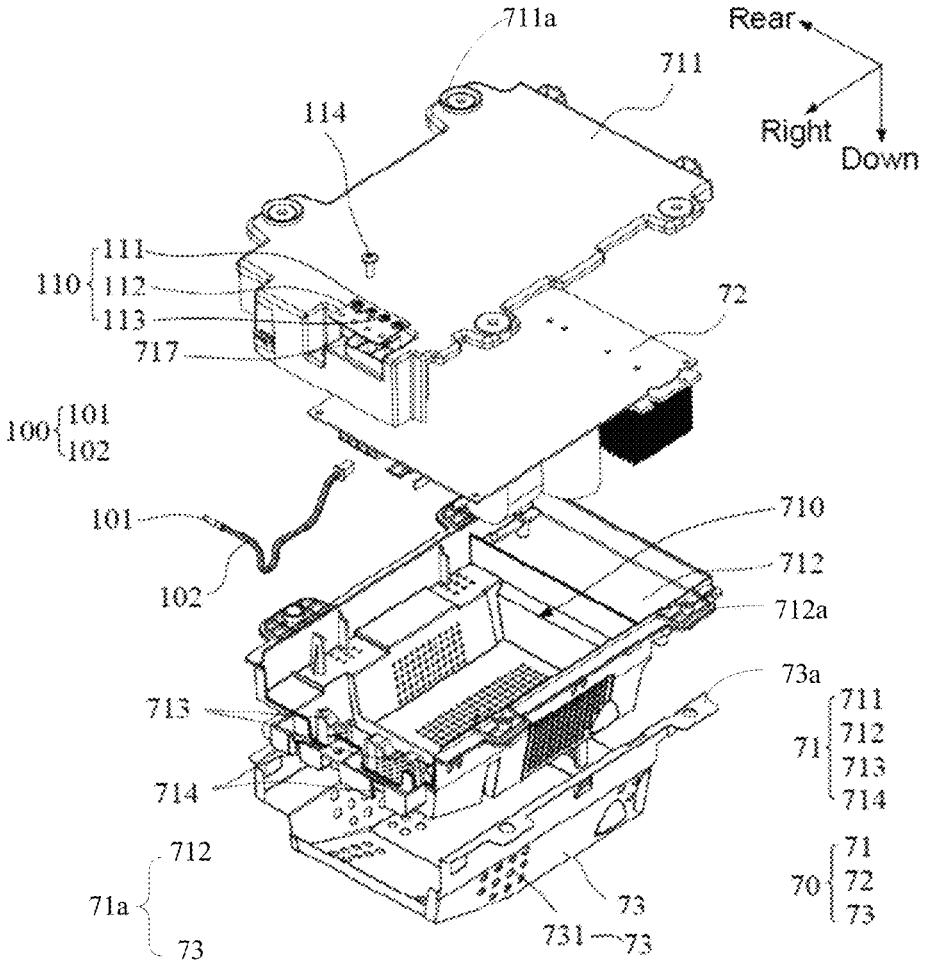
FIG. 7 is an exploded view of an electrical control assembly in an air conditioner, in accordance with some embodiments.
Figure 8:
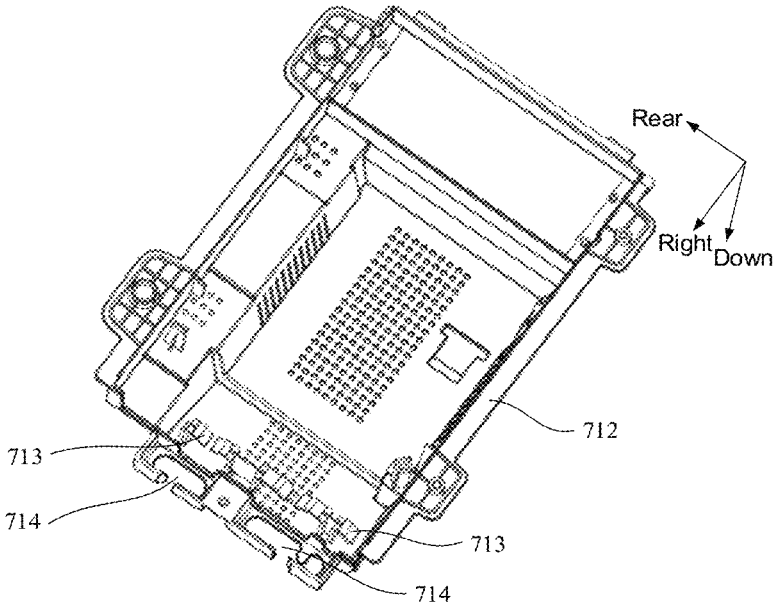
FIG. 8 is a diagram showing a structure of a box body in an electrical control assembly, in accordance with some embodiments.
Figure 9:
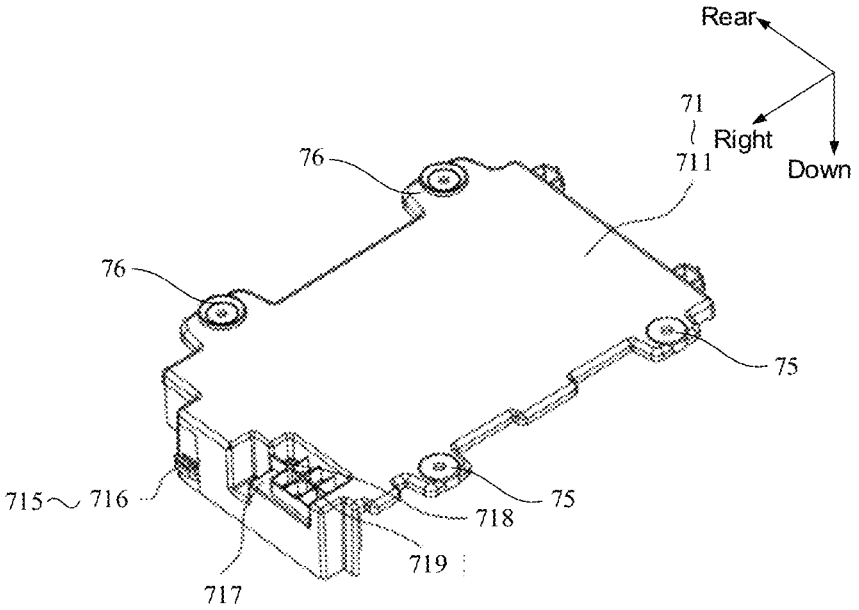
FIG. 9 is a diagram showing a structure of a cover in an electrical control assembly, in accordance with some embodiments.

FIG. 6 is a diagram showing a structure of an electrical control assembly in an air conditioner, in accordance with some embodiments. FIG. 7 is an exploded view of an electrical control assembly in an air conditioner, in accordance with some embodiments. FIG. 8 is a diagram showing a structure of a box body in an electrical control assembly, in accordance with some embodiments. FIG. 9 is a diagram showing a structure of a cover in an electrical control assembly, in accordance with some embodiments.

In some embodiments, as shown in FIGS. 6 and 7, the electrical control assembly 70 includes an electrical box 71 and a controller 72 disposed in the electrical box 71.

As shown in FIGS. 7 to 9, the electrical box 71 includes a cover 711 and an accommodating portion 71*a*. The cover 711 is covered on the accommodating portion 71*a* so as to form an internal space 710 of the electrical box 71, and the controller 72 is installed in the internal space 710.

In some embodiments, the accommodating portion 71*a* further includes a box body 712 and a protective cover 73. The protective cover 73 is disposed on a side of the box body 712 away from the cover 711, and covered an outside of the box body 712, so as to protect the electrical control assembly 70, and prevent condensed water from entering the electrical control assembly 70. Moreover, since the electrical control assembly 70 is proximate to the outdoor air inlet 21, it is possible to prevent foreign matter from entering the electrical control assembly 70 through the protective cover 73, so as to avoid affecting the operation of the electrical control assembly 70. For example, the protective cover 73 is disposed at a position of the bottom of the box body 712. The protective cover 73 has a plurality of heat dissipation holes 731 for the heat dissipation of the controller 72.

In some embodiments, as shown in FIGS. 7 and 8, the electrical box 71 further includes a clamping hook 713 and a first via hole 714, and the clamping hook 713 corresponds to the first via hole 714. The clamping hook 713 is disposed on an inner wall surface of the box body 712, so as to constrain the wire harness. The first via hole 714 is disposed on a side of the box body 712 for the wire harness to run in or out. The wire harness passes through the first via hole 714 and is clamped by the clamping hook 713. For example, the electrical box 71 includes a plurality of groups of clamping hooks 713 and first via holes 714 that are arranged at intervals, and thus, the arrangement of the wire harness is more orderly.

Grounding Piece

In some embodiments, as shown in FIG. 6, the air conditioner 1 further includes a grounding piece 110, and the grounding piece 110 is installed on an outer side wall of the electrical box 71 proximate to the compressor 60. For example, the electrical control assembly 70 includes a first mounting groove 717 configured to accommodate the grounding piece 110. The first mounting groove 717 is disposed on the electrical box 71. For example, the first mounting groove 717 is formed by a surface (e.g., the upper surface) of the cover 711 away from the box body 712 being recessed toward the direction proximate to the base 10.

A ground wire of the controller 72 and a ground wire of the power supply are connected to the grounding piece 110, and the grounding piece 110 is connected to the indoor heat exchanger 419 (as shown in FIG. 3) which is grounded through a wire, so as to realize the grounding of the ground wire of the controller 72 and the ground wire of the power supply, and shorten the wiring distance.

In some embodiments, as shown in FIG. 6, a side (e.g., the right side) of the first mounting groove 717 proximate to the outdoor air inlet 21 is opened to form a third opening 7170. In this way, the ground wire of the controller 72, the ground wire of the power supply, and the wire between the grounding piece 110 and the indoor heat exchanger 419 may run in or out from the third opening 7170, which facilitates operation of wiring.

In some embodiments, the grounding piece 110 includes a metal plate, and the grounding piece 110 is installed in the first mounting groove 717 by means of a first fastener 114 (e.g., a screw). For example, as shown in FIG. 7, the grounding piece 110 includes a grounding piece body 111, a positioning hole 112 and a second via hole 113. The positioning hole 112 and the second via hole 113 run through the grounding piece body 111. In this case, as shown in FIG. 9, the first mounting groove 717 includes a positioning portion 718 and a third connecting hole 719. The positioning portion 718 and the third connecting hole 719 are disposed on a groove bottom of the first mounting groove 717. The positioning portion 718 is matched with the positioning hole 112, so as to position the grounding piece 110. The first fastener 114 passes through the second via hole 113 to be connected to the third connecting hole 719 (e.g., a threaded hole), so as to fixedly connect the grounding piece 110 to the electrical box 71.

Fixation of Electrical Control Assembly

In some embodiments, at least one of the sides of the indoor unit 40 and the outdoor unit 50 that are proximate to each other is provided with a groove 41*a*. For example, the groove 41*a* may be provided on the side of the indoor unit 40 that is proximate to the outdoor unit 50, or on the side of the outdoor unit 50 that is proximate to the indoor unit 40, or on both sides of the indoor unit 40 and the outdoor unit 50 that are proximate to each other. As shown in FIG. 3, grooves 41*a* are provided on both the side of the indoor unit 40 that is proximate to the outdoor unit 50 and the side of the outdoor unit 50 that is proximate to the indoor unit 40.

Corresponding to the arrangement of the groove 41*a*, the electrical control component 70 is correspondingly provided with a connecting portion 41*b*, which is located on one or both sides of the electrical control component 70 in its length direction. For example, when the groove 41*a* is provided on the side of the indoor unit 40 that is proximate to the outdoor unit 50, the connecting portion 41*b* is correspondingly provided on the side of the electrical control component 70 that is proximate to the indoor unit 40. When the groove 41*a* is provided on the side of the outdoor unit 50 that is proximate to the indoor unit 40, the connecting portion 41*b* is correspondingly provided on the side of the electrical control component 70 that is proximate to the outdoor unit 50. When grooves 41*a* are provided on both the side of the indoor unit 40 that is proximate to the outdoor unit 50 and the side of the outdoor unit 50 that is proximate to the indoor unit 40, the connecting portions 41*b* are correspondingly provided on both the side of the electrical control component 70 that is proximate to the outdoor unit 50 and the side that is proximate to the indoor unit 40. The connecting portion 41*b* protrudes from one side of the electrical control component 70 and extends to the groove 41*a*, entering into the corresponding groove 41*a* to form a connection with the indoor unit or the outdoor unit. For example, the connecting portion 41*b* may be positioned or fixed in the groove 41*a* using fasteners or the like. In some embodiments, as shown in FIG. 3, both the indoor unit 40 and the outdoor unit 50 are provided with grooves 41*a* on their sides that are proximate to each other, for example, the indoor unit 40 includes a first groove 411, and the outdoor unit 50 includes a second groove 511. The first groove 411 is disposed on a side (e.g., the rear side) of the indoor air duct component 410 proximate to the outdoor unit 50, and is recessed in a direction away from the outdoor unit 50. The second groove 511 is disposed on a side (e.g., the front side) of the outdoor air duct component 510 proximate to the indoor unit 40, and is recessed in a direction away from the indoor unit 40.

In this case, as shown in FIGS. 3 and 9, the connecting portion 41*b* of the electrical control assembly 70 includes a first connecting portion 75 and a second connecting portion 76. The first connecting portion 75 and the second connecting portion 76 are oppositely disposed on the electrical box 71, and the first connecting portion 75 is installed in the first groove 411, and the second connecting portion 76 is installed in the second groove 511.

In some embodiments, the first groove 411 is arranged at an interval with the indoor heat exchange air duct 417, and the second groove 511 is arranged at an interval with the outdoor heat exchange air duct 513, so as to prevent the first groove 411 and the second groove 511 from affecting the indoor heat exchange air duct 417 and the outdoor heat exchange air duct 513. For example, the first groove 411 is disposed on a rear surface of the indoor air duct component 410, and is located outside a region of the rear surface opposite to the indoor heat exchange air duct 417. Therefore, in a case where a depth of the first groove 411 satisfies the installation of the electrical control assembly 70, it is possible to prevent the first groove 411 from penetrating into the indoor heat exchange air duct 417 in a case where the first groove 411 extends in a direction proximate to the base 10.

Figure 10:
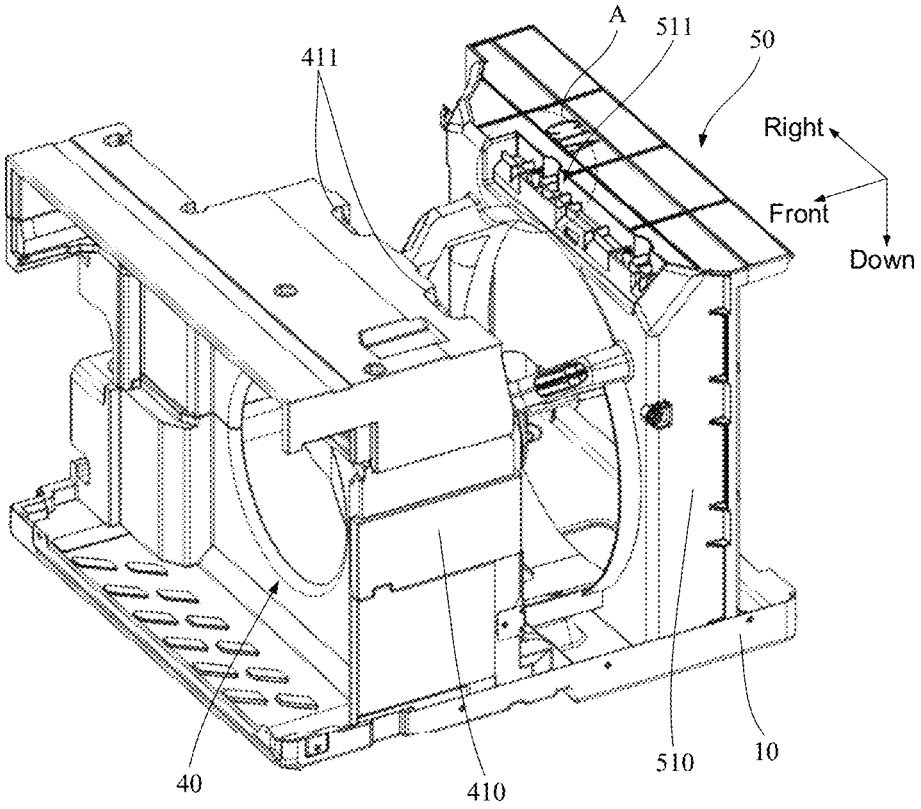
FIG. 10 is a diagram showing a structure of an indoor unit, an outdoor unit and a base in an air conditioner, in accordance with some embodiments.
Figure 11:
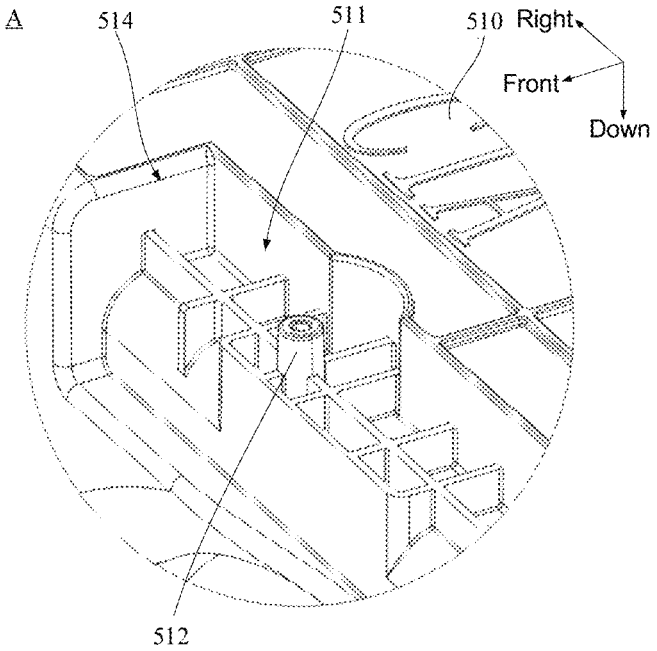
FIG. 11 is a partial enlarged view of the circle A in FIG. 10.
Figure 12:
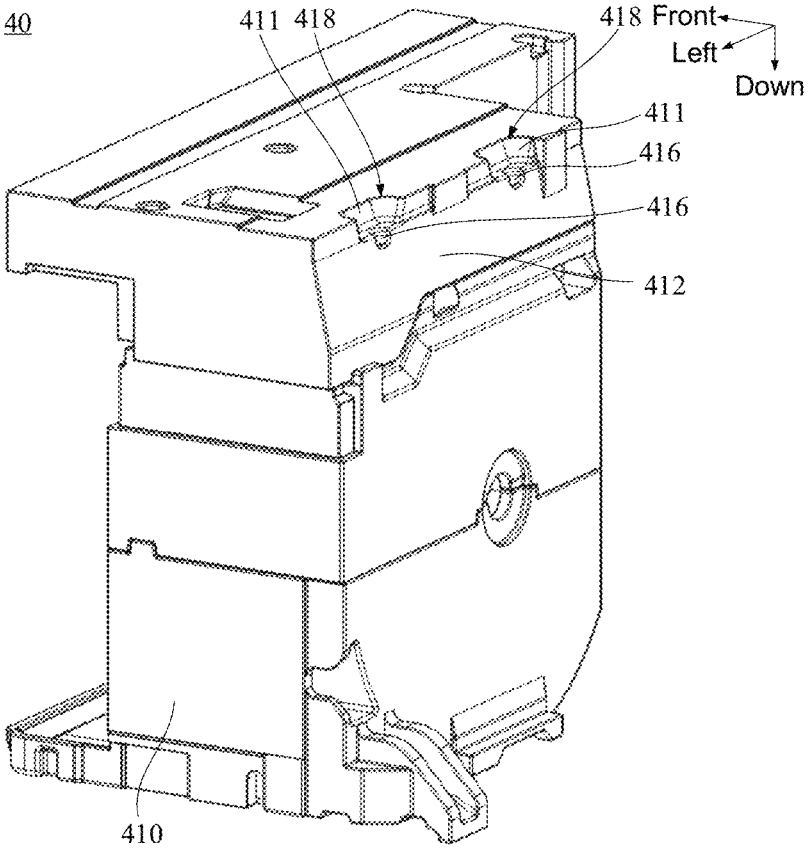
FIG. 12 is a diagram showing a structure of an indoor unit in an air conditioner, in accordance with some embodiments.

FIG. 10 is a diagram showing a structure of an indoor unit, an outdoor unit and a base in an air conditioner, in accordance with some embodiments. FIG. 11 is a partial enlarged view of the circle A in FIG. 10. FIG. 12 is a diagram showing a structure of an indoor unit in an air conditioner, in accordance with some embodiments.

In some embodiments, as shown in FIG. 10, a side (e.g., the upper side) of the first groove 411 away from the base 10 is opened, so as to form a first opening 418 (as shown in FIG. 12). Moreover, a side (e.g., the upper side) of the second groove 511 away from the base 10 is opened, so as to form a second opening 514 (as shown in FIG. 11). In this way, the first connecting portion 75 and the second connecting portion 76 of the electrical control assembly 70 may enter the first groove 411 and the second groove 511 through the first opening 418 and the second opening 514 from top to bottom, and be accommodated in the first groove 411 and the second groove 511 respectively.

In some embodiments, as shown in FIGS. 11 and 12, the indoor unit 40 includes a first mounting portion 416, and the outdoor unit 50 includes a second mounting portion 512. The first mounting portion 416 is disposed on a surface of the first groove 411 proximate to the base 10, and the second mounting portion 512 is disposed on a surface of the second groove 511 proximate to the base 10. The first connecting portion 75 of the electrical control assembly 70 is fixedly connected to the first mounting portion 416, and the second connecting portion 76 of the electrical control assembly 70 is fixedly connected to the second mounting portion 512, so that the electrical control assembly 70 is installed on the indoor air duct component 410 and the outdoor air duct component 510.

For example, as shown in FIG. 6, the first connecting portion 75 of the electrical control assembly 70 has a first connecting hole 751, and the second connecting portion 76 of the electrical control assembly 70 has a second connecting hole 761. Second fasteners (e.g., screws) pass through the first connecting hole 751 and the second connecting hole 761 respectively, and are fixedly connected to the first mounting portion 416 and the second mounting portion 512, so as to fixedly connect the electrical control assembly 70 to the indoor air duct component 410 and the outdoor air duct component 510.

By providing the connecting structure between the electrical control assembly 70 and the indoor air duct component 410 in the first groove 411, and by providing the connecting structure between the electrical control assembly 70 and the outdoor air duct component 510 in the second groove 511, it is possible to disassemble the second fasteners from or assemble the second fasteners into the first opening 418 and the second opening 514, which facilitates the assembly and disassembly of the electrical control assembly 70.

In some embodiments, as shown in FIG. 3, the indoor unit 40 includes a plurality of first grooves 411. The plurality of first grooves 411 are arranged in a width direction (e.g., the left-right direction) of the air conditioner 1 at an interval. The outdoor unit 50 includes a second groove 511 and the second groove 511 extends in the width direction of the air conditioner 1. The electrical control assembly 70 includes a plurality of first connecting portions 75 and a plurality of second connecting portions 76, and the plurality of first connecting portions 75 correspond to the plurality of first grooves 411, and the plurality of second connecting portions 76 correspond to the second groove 511. In this way, it is conducive to improving the mounting stability of the electrical control assembly 70. In some embodiments, the outdoor unit 50 may include a plurality of second grooves 511, the plurality of second grooves 511 are arranged in a width direction of the air conditioner 1 at an interval, and the plurality of second connecting portions 76 correspond to the plurality of second grooves 511.

In some embodiments, the electrical control assembly 70 is fixedly connected to the indoor air duct component 410 and the outdoor air duct component 510. Alternatively, the electrical control assembly 70 is fixedly installed on the housing 20.

In some embodiments, as shown in FIG. 12, a part (e.g., the upper part) of the rear surface of the indoor air duct component 410 is recessed toward an interior of the indoor air duct component 410, so as to form a mounting space 412. The first groove 411 is located in the mounting space 412. In this way, an orthogonal projection of the electrical control assembly 70 on the base 10 overlaps with an orthogonal projection of the indoor air duct component 410 on the base 10, which may increase a space on a side of the indoor air duct component 410 for accommodating the electrical control assembly 70, and is conducive to reducing a distance between the indoor unit 40 and the outdoor unit 50, and reducing a volume of the air conditioner 1.

In some embodiments of the present disclosure, when the air conditioner 1 is assembled, the first groove 411 and the second groove 511 each may accommodate a part of the electrical control assembly 70, which may reduce a distance between the indoor air duct component 410 and the outdoor air duct component 510, and reduce a length of the air conditioner 1, and reduce the space occupied by the air conditioner 1. Moreover, the first groove 411 is disposed on the rear surface of the indoor air duct component 410, while the indoor heat exchange air duct 417 is proximate to a front surface of the indoor air duct component 410, so that the first groove 411 is arranged at an interval with the indoor heat exchange air duct 417, thereby preventing the indoor heat exchange air duct 417 from being affected by the first groove 411, and in turn the heat exchange performance of the indoor unit 40 from being affected by the first groove 411.

In addition, the mounting space 412 is arranged at an interval with the indoor heat exchange air duct 417. In this way, it is possible to prevent the mounting space 412 from penetrating into the indoor heat exchange air duct 417, so as not to affect the heat exchange effect of the indoor unit 40. The benefit of the second groove 511 is similar to that of the first groove 411, and details will not be repeated herein.

As shown in FIGS. 7 and 8, at least one side of the cover 711 of the electrical control component 70 is provided with a connecting portion 711*a*, and at least one side of the accommodation section 71*a* of the electrical control component 70 is provided with a connecting portion (e.g., connecting portion 712*a* and/or connecting portion 73*a*). Both the connecting portion of the cover 711 and the connecting portion of the accommodation section 71*a* extend into the groove 41*a* and connect to the indoor unit 40 and/or the outdoor unit 50 within the groove 41*a*. The at least one side of the cover 711 and the at least one side of the accommodation section 71*a* may be the same side or different sides. In the case of the same side, one of the indoor unit 40 and the outdoor unit 50 is provided with the groove 41*a*, and this same side is the side proximate to the indoor unit 40 or the outdoor unit 50. In the case of different sides, both the indoor unit 40 and the outdoor unit 50 are provided with the groove 41*a*. Additionally, when both sides of the cover 711 and both sides of the accommodation section 71*a* are provided with connecting portions, both the indoor unit 40 and the outdoor unit 50 are provided with the groove 41*a*.

As shown in FIGS. 7 and 8, both sides of the cover 711 proximate to the groove 41*a* are provided with connecting portions 711*a*, and both sides of the accommodation section 71*a* of the electrical control component 70 are provided with connecting portions (e.g., both sides of the box body 712 and the protective cover 73 are provided with connecting portions). The connecting portions 711*a* of the cover 711, the connecting portions 712*a* of the box body 712, and the connecting portions 73*a* of the protective cover 73 all extend into the groove 41*a* and are fixedly connected to the indoor unit 40 and the outdoor unit 50 within the groove 41*a*.

In some variable embodiments, the box body 712 may not be provided with a connecting portion, while the protective cover 73 and the cover 711 are respectively provided with connecting portions 73*a* and 711*a*, and the connecting portion 73*a* of the protective cover 73 and the connecting portion 711*a* of the cover 711 are in contact and connected within the groove 41*a*.

In some embodiments, two connecting portions 711*a* are provided on one side of the cover 711 proximate to the groove 41*a*, and the two connecting portions 711*a* are spaced apart along the length direction of the cover 711. The side of the cover 711 away from the groove 41*a* may not be provided with a connecting portion. In a variable embodiment, more than two connecting portions 711*a* may also be provided on the same side of the cover 711.

In some embodiments of the present disclosure, at least one of the box body 712 and the protective cover 73 is provided with a connecting portion to be connected to the groove 41*a*. For example, at least one side of the box body 712 is provided with a connecting portion 712*a*, or at least one side of the protective cover 73 is provided with a connecting portion 73*a*, or at least one side of the box body 712 and at least one side of the protective cover 73 are each provided with a connecting portion.

Supporting for Electrical Control Assembly

Figure 13:
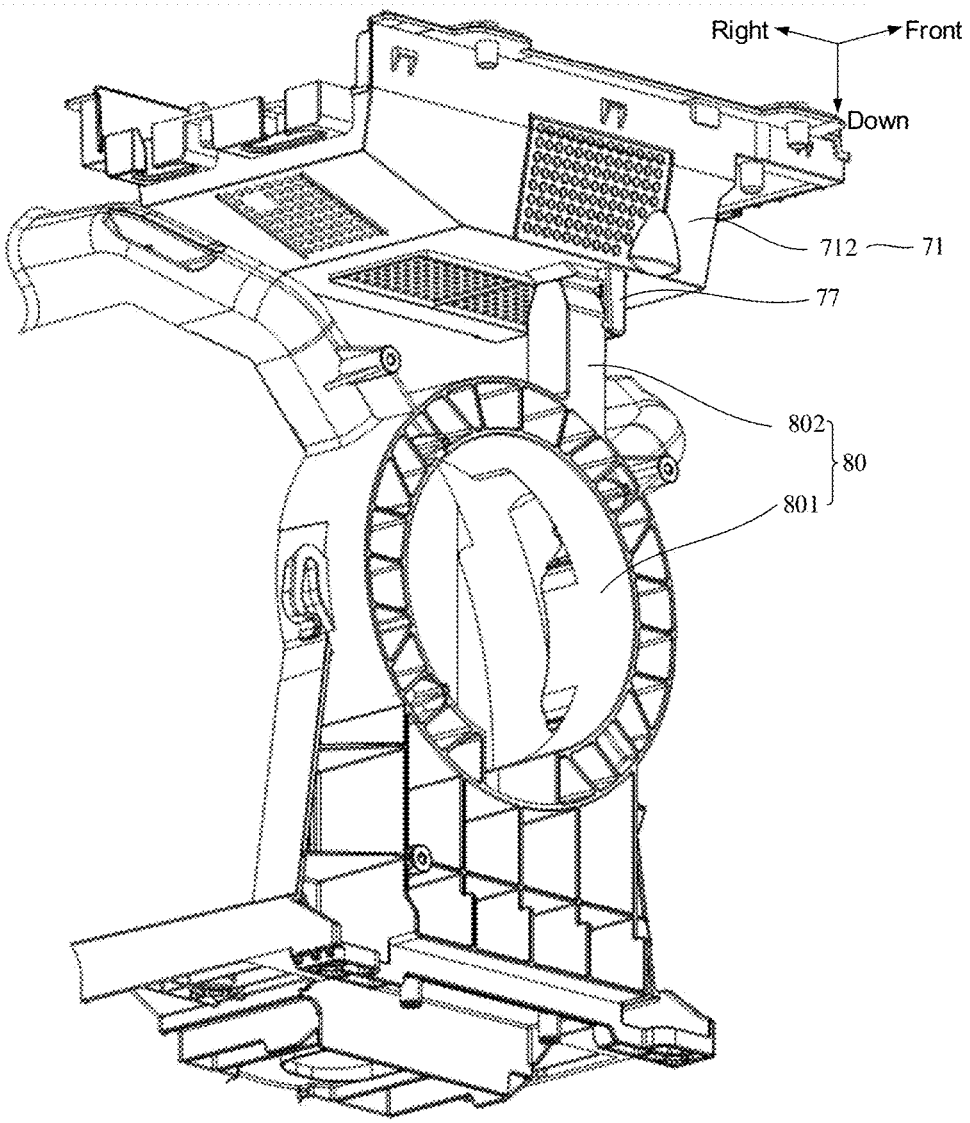
FIG. 13 is a diagram showing a structure of a mounting frame and an electrical control assembly in an air conditioner, in accordance with some embodiments.
Figure 14:
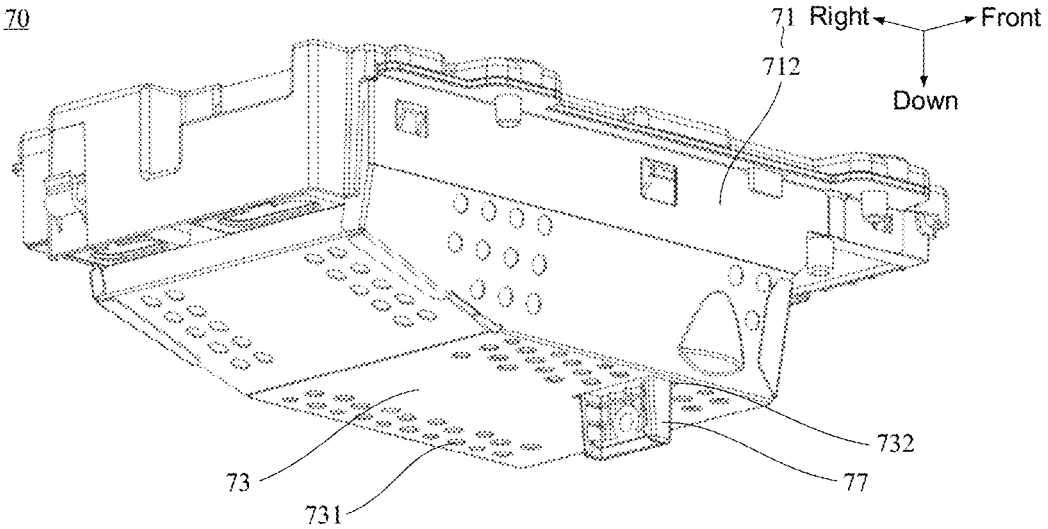
FIG. 14 is a diagram showing a structure of an electrical control assembly in an air conditioner from another perspective, in accordance with some embodiments.

FIG. 13 is a diagram showing a structure of a mounting frame and an electrical control assembly in an air conditioner, in accordance with some embodiments. FIG. 14 is a diagram showing a structure of an electrical control assembly in an air conditioner from another perspective, in accordance with some embodiments.

In some embodiments, as shown in FIG. 4B, the air conditioner 1 further includes a mounting frame 80, and the fan assembly 90 is installed on mounting frame 80. The mounting frame 80 is disposed on a side (e.g., the front side) of the outdoor air duct component 510 proximate to the indoor unit 40, and is connected to the outdoor air duct component 510.

In some embodiments, as shown in FIG. 13, the mounting frame 80 includes a mounting frame body 801 and a connecting frame 802. The connecting frame 802 is connected to the mounting frame body 801 and is located on the side of the mounting frame body 801 that is proximate to the electrical control component 70.

As shown in FIG. 13, the mounting frame body 801 has a frame 801*b*, the center of which is provided with a central hole 801*a* for mounting the fan assembly 90. The connecting frame 802 is positioned on a side of the frame 801*b* away from the base 10 and extends toward the electrical control component 70. That is, the connecting frame 802 extends from the top of the frame 801*b* in a direction of the electrical control component 70.

The electrical control component 70 also includes a first mounting base 77, which is provided on the electrical box 71. The connecting frame 802 establishes a connection with the first mounting base 77 to support the electrical control component 70.

For example, the connecting frame 802 is fixedly connected to the first mounting base 77, so as to support the electrical control assembly 70.

For example, as shown in FIGS. 13 and 14, the first mounting base 77 is disposed at the bottom surface of the box body 712, and the protective cover 73 of the electrical control assembly 70 has a third via hole 732. The first mounting base 77 passes through the third via hole 732, and is fixedly connected to the connecting frame 802.

In this way, in a case where the electrical control assembly 70 is installed on the housing 20, the connecting frame 802 of the mounting frame 80 is fixedly connected to the first mounting base 77, so as to support the electrical control assembly 70, so that the force applied on the housing 20 by the electrical control assembly 70 is small, and the housing 20 is not easy to deform.

In some embodiments, as shown in FIG. 13, the mounting frame body 801 is substantially in a shape of an annular, and is fixedly connected to the base 10, which is conducive to improving the stability of the electrical control assembly 70.

Figure 15:
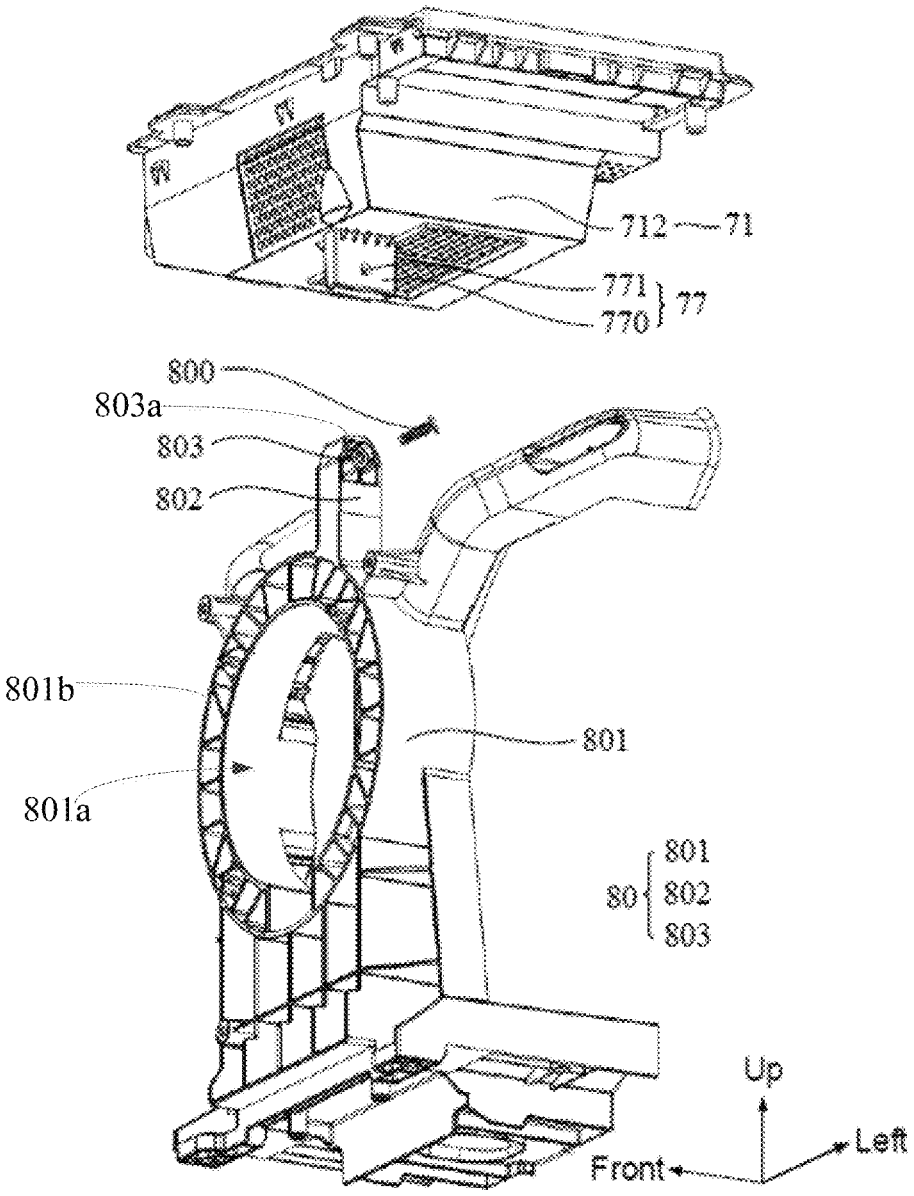
FIG. 15 is an exploded view of a mounting frame and an electrical control assembly in an air conditioner, in accordance with some embodiments.
Figure 16:
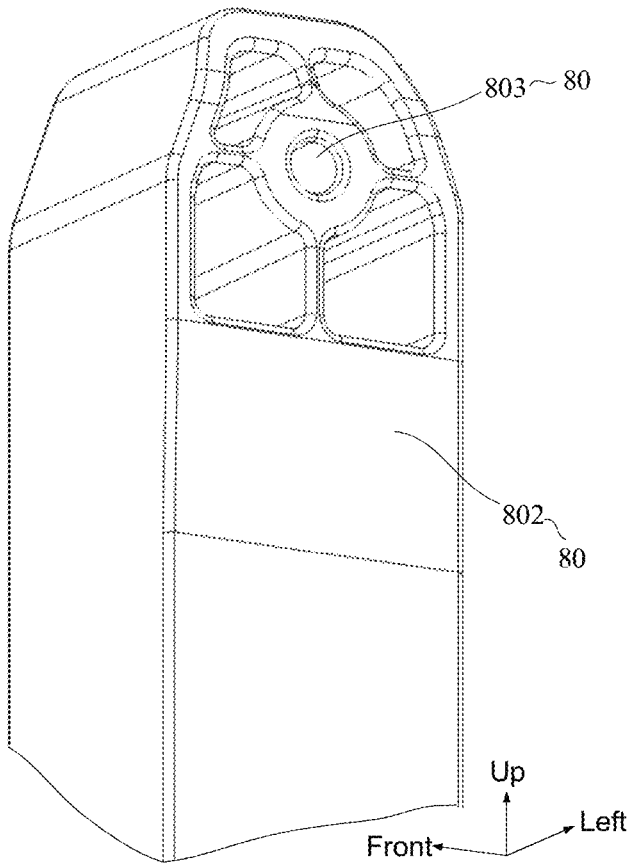
FIG. 16 is a diagram showing a structure of a connecting frame in a mounting frame, in accordance with some embodiments.

FIG. 15 is an exploded view of a mounting frame and an electrical control assembly in an air conditioner, in accordance with some embodiments. FIG. 16 is a diagram showing a structure of a connecting frame in a mounting frame, in accordance with some embodiments.

In some embodiments, as shown in FIGS. 15 and 16, the mounting frame 80 further includes a mounting sub-portion 803. The mounting sub-portion 803 is fixedly connected to the first mounting base 77, and located at an end of the connecting frame 802 proximate to the electrical control assembly 70.

For example, as shown in FIG. 16, the mounting sub-portion 803 includes a threaded hole. As shown in FIG. 15, the first mounting base 77 includes a mounting base body 770. The mounting base body 770 is connected to the bottom of the box body 712, and extends in a direction away from the box body 712. As shown in FIGS. 14 and 15, the mounting base body 770 protrudes from the surface of the protective cover 73 that is proximate to the mounting frame 802. The first mounting base 77 is installed on the protective cover 73 or on the box body 712. When first mounting base 77 is installed on the box body 712, the protective cover 73 is provided with a through-hole through which the first mounting base 77 extends toward the connecting frame 802. The first mounting base 77 further includes a mounting hole 771. The mounting hole 771 is disposed on the mounting base body 770, and corresponds to the mounting sub-portion 803. A connecting member 800 (e.g., a screw) passes through the mounting hole 771 and is fixedly connected to the mounting sub-portion 803, which may make the first mounting base 77 firmly connected to the connecting frame 802, and may avoid the relative movement of the first mounting base 77.

In some embodiments, as shown in FIG. 15, the connecting member 800 is disposed horizontally (i.e., the connecting member 800 is parallel to a plane where the base 10 is located), so as to limit the positions of the first mounting base 77 and the connecting frame 802, so that the first mounting base 77 and the connecting frame 802 are not easy to displace in the horizontal direction. Moreover, the electrical control assembly 70 may be installed on the indoor air duct component 410 and the outdoor air duct component 510 through the second fasteners extending in a vertical direction, so that the position of the electrical control assembly 70 may be limited, and the electrical control assembly 70 is not easy to displace in the vertical direction, which is conducive to improving the stability of the electrical control assembly 70.

In some embodiments, as shown in FIG. 13, an end (e.g., the upper end) of the connecting frame 802 away from the base 10 abuts against the bottom of the box body 712, so as to support the electrical control assembly 70, which further improves the stability of the electrical control assembly 70.

Optionally, the end (e.g., the upper end) of the connecting frame 802 away from the base 10 abuts against a side of the electrical control assembly 70 proximate to the base 10.

Figure 17:
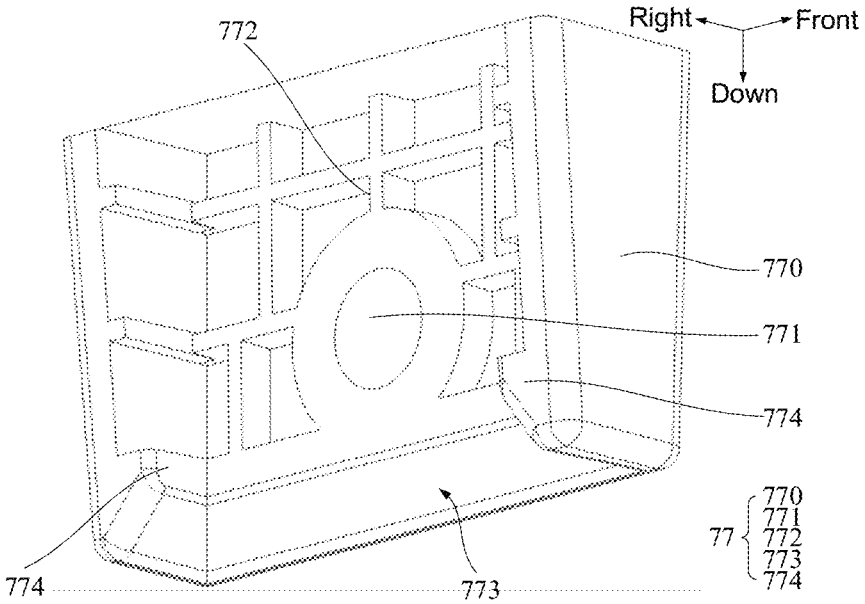
FIG. 17 is a diagram showing a structure of a first mounting base in an electrical control assembly, in accordance with some embodiments.

FIG. 17 is a diagram showing a structure of a first mounting base in an electrical control assembly, in accordance with some embodiments.

In some embodiments, as shown in FIG. 17, the first mounting base 77 further includes a connecting groove 772, and the connecting groove 772 is disposed on a side (e.g., the right side) of the mounting base body 770 proximate to the mounting sub-portion 803. The upper end of the connecting frame 802 is matched with the connecting groove 772. For example, the upper end of the connecting frame 802 is connected to the connecting groove 772. An external shape of the upper end of the connecting frame 802 matches a shape of the connecting groove 772 enclosed, in order to ensure that when the upper end of the connecting frame 802 is inserted into the connecting groove 772, the external surface of the upper end of the connecting frame 802 is in contact with an inner wall of the connecting groove 772. For example, the upper end of the connecting frame 802 is clamped with the connecting groove (i.e. snap-fitted into the connecting groove). As shown in FIG. 15, the upper end of the connecting frame 802 is clamped with the connecting groove 772 in the vertical direction. For example, the plug-in portion 803*a* of the mounting sub-portion 803 is snap-fitted into the connecting groove 772. Through the cooperation of the connecting frame 802 and the connecting groove 772, it is possible to realize the positioning of the connecting frame 802 and the first mounting base 77. As shown in FIG. 17, the plug-in portion 803*a* and the connecting groove 772 achieve a snap-fit connection in the vertical direction (i.e., a length direction of the electrical control component 70).

Additionally, as shown in FIG. 3 and FIG. 4, the connecting portion 41*b* of the electrical control assembly 70 is connected to the groove 41*a* provided on at least one of the indoor unit and the outdoor unit in the length direction (in the horizontal direction) of the electrical control component 70. The electrical control component is connected to the indoor unit and/or the outdoor unit in the horizontal direction, and to the connecting frame in the vertical direction. By connections in two directions, the strength of the connection can be enhanced. The electrical control component 70 is more securely and stably positioned.

Additionally, the connecting groove 772 may also be provided at the upper end of the connecting frame 802 (i.e., the mounting sub-portion 803 comprises the connecting groove), and the first mounting base 77 may be correspondingly provided with a plug-in section 771 that is inserted into the connecting groove 772. This arrangement also enables a snap-fit connection between the electrical control component 70 and the connecting frame 802.

In some embodiments, the first mounting base 77 further includes a sliding inlet 773 and a first buckle 774. An end of the connecting groove 772 proximate to the base 10 is opened to form the sliding inlet 773. The first buckle 774 is disposed on an inner side wall of the connecting groove 772 and is proximate to the sliding inlet 773. The first buckle 774 is configured to be clamped with a portion (e.g., the upper portion) of the connecting frame 802. The upper portion of the connecting frame 802 is inserted into the connecting groove 772 through the sliding inlet 773, and fastened with the first buckle 774.

During a process of installing the first mounting base 77 and the connecting frame 802, the upper portion of the connecting frame 802 is inserted into the connecting groove 772 from the sliding inlet 773 until the upper portion of the connecting frame 802 is fastened with the first buckle 774, so as to fixedly connect the first mounting base 77 to the connecting frame 802. Moreover, through the cooperation of the connecting frame 802 and the first buckle 774, it is possible to position the first mounting base 77. Therefore, when the connecting member 800 is installed, the position between the first mounting base 77 and the connecting frame 802 does not need to be adjusted, which is conducive to saving the installation time and improving the assembly efficiency.

In some embodiments, as shown in FIG. 17, the first mounting base 77 includes two first buckles 774. The two first buckles 774 are respectively disposed on two opposite inner side walls of the connecting groove 772. In this way, the accuracy of positioning and securing effect of the first mounting base 77 may be improved.

In some embodiments of the present disclosure, through making the first mounting base 77 of the electrical control assembly 70 fixedly connected to the connecting frame 802, and making the electrical control assembly 70 fixed on the outdoor air duct component 510 through the connecting frame 802 and the mounting frame body 801, it is possible to reduce the force applied on the housing 20 by the electrical control assembly 70, and prevent the housing 20 from being deformed. In addition, through the support of the outdoor air duct component 510, it is possible to improve the stability of the electrical control assembly 70, and avoid affecting the electrical control assembly 70 due to the deformation of the housing 20.

First Temperature Sensor and Second Mounting Base

In some embodiments, as shown in FIG. 6, the air conditioner 1 includes a first temperature sensor 100 located at one side of the electrical control component 70 in a width direction (i.e., the left-right direction). The first temperature sensor 100 is electrically connected to the controller 72, and configured to detect an outdoor ambient temperature. For example, the first temperature sensor 100 includes a temperature probe 101 and a connecting wire 102. A first end of the connecting wire 102 is connected to the temperature probe 101, and a second end of the connecting wire 102 is electrically connected to the controller 72.

In some embodiments, as shown in FIG. 2, the electrical control assembly 70 further includes a second mounting base 715. The second mounting base 715 is disposed on a side (e.g., the right side) of the electrical box 71 proximate to the outdoor air inlet 21. The temperature probe 101 is installed on the second mounting base 715.

Figure 18:
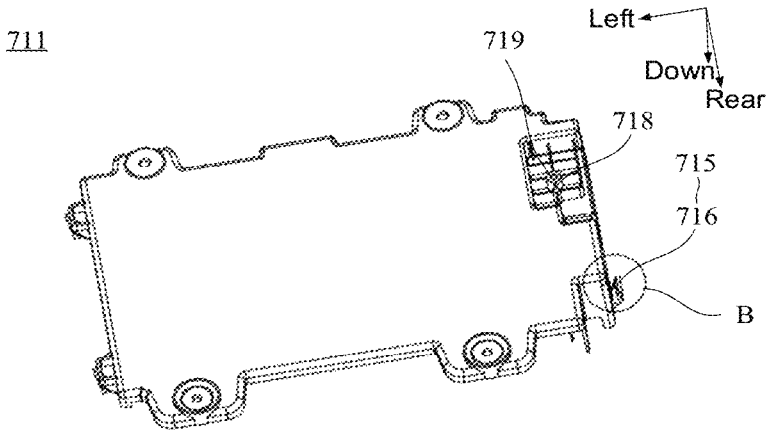
FIG. 18 is a diagram showing a structure of a cover in an electrical control assembly from another perspective, in accordance with some embodiments.
Figure 19:
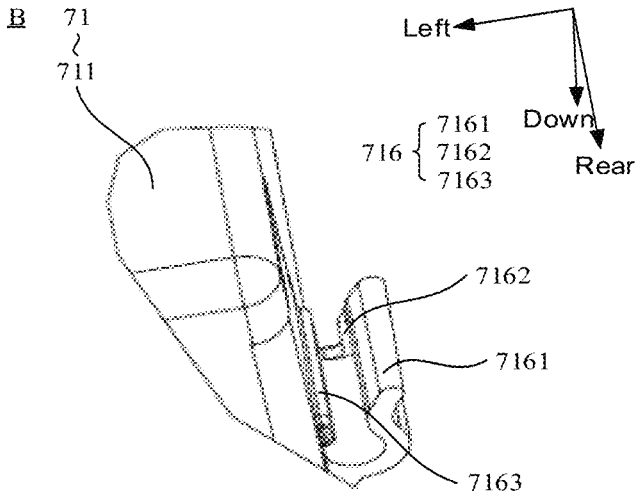
FIG. 19 is a partial enlarged view of the circle B in FIG. 18.

FIG. 18 is a diagram showing a structure of a cover in an electrical control assembly from another perspective, in accordance with some embodiments. FIG. 19 is a partial enlarged view of the circle B in FIG. 18.

For example, as shown in FIGS. 9, 18 and 19, the second mounting base 715 includes a second buckle 716 disposed on the cover 711, and the second buckle 716 is clamped with the temperature probe 101, which facilitates disassembly and assembly of the temperature probe 101, and is convenient to adjust the position of the temperature probe 101.

In some embodiments, the second buckle 716 and the electrical box 71 are an integral member, so that the structure is simple and the cost is low.

In some embodiments, as shown in FIG. 19, the second buckle 716 includes a buckle body 7161, a first convex rib 7162 and a second convex rib 7163. The buckle body 7161 is fixedly connected to the cover 711. The first convex rib 7162 is disposed on an inner side wall of the buckle body 7161, and the second convex rib 7163 is disposed on a side wall of the cover 711 opposite to the buckle body 7161.

For example, the first convex rib 7162 extends in an up-down direction. The temperature probe 101 abuts against the first convex rib 7162, and the first convex rib 7162 is located on a right side of the temperature probe 101, so as to prevent the temperature probe 101 from falling off in the horizontal direction. The second convex rib 7163 extends in a front-rear direction, the temperature probe 101 abuts against the second convex rib 7163, and the second convex rib 7163 is located above the temperature probe 101, so as to prevent the temperature probe 101 from falling off in the vertical direction. In this way, the temperature probe 101 may be stably fixed by means of the second buckle 716.

In some embodiments, as shown in FIG. 2, the second mounting base 715 is located above the compressor 60. In this way, in the up-down direction, the temperature probe 101 is spaced apart from the compressor 60 by a certain distance, which prevents the heat of the compressor 60 from affecting the detection of the first temperature sensor 100, and is conducive to improving the accuracy of the first temperature sensor 100 for detecting the outdoor ambient temperature.

In some embodiments of the present disclosure, the outdoor air enters the space between the indoor unit 40 and the outdoor unit 50 through the outdoor air inlet 21, and flows into the outdoor unit 50 for heat exchange after passing through the compressor 60 and the first temperature sensor 100. The electrical control assembly 70 is arranged at an interval with the compressor 60, which may prevent a region where the first temperature sensor 100 is located from being affected by the heat of the compressor 60, so that the outdoor ambient temperature may be accurately detected and the operation of the air conditioner 1 may be accurately controlled.

Panel Assembly

Figure 20:
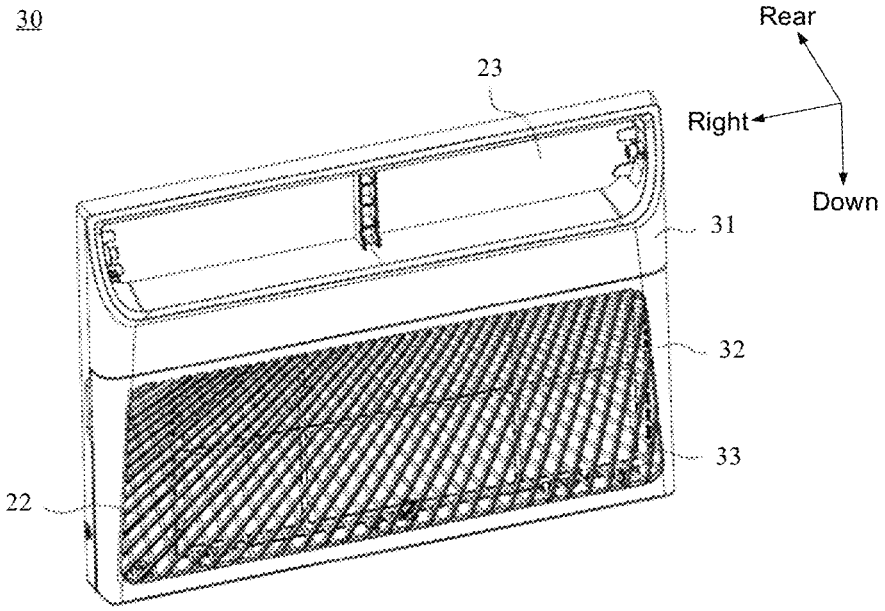
FIG. 20 is a diagram showing a structure of a panel assembly in an air conditioner, in accordance with some embodiments.
Figure 21:
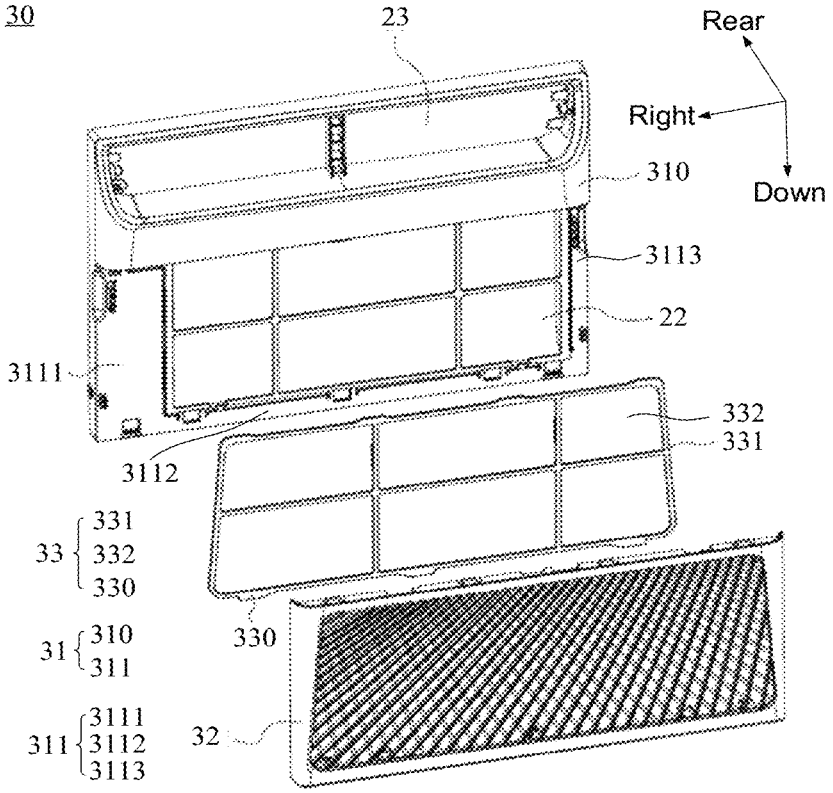
FIG. 21 is an exploded view of a panel assembly in an air conditioner, in accordance with some embodiments.
Figure 22:
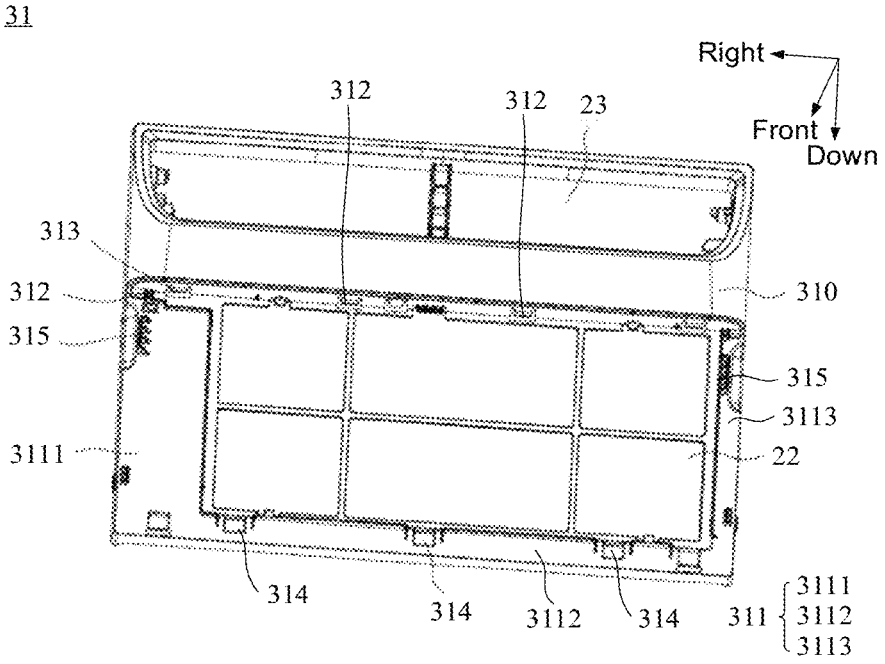
FIG. 22 is a diagram showing a structure of a panel base in a panel assembly, in accordance with some embodiments.

FIG. 20 is a diagram showing a structure of a panel assembly in an air conditioner, in accordance with some embodiments. FIG. 21 is an exploded view of a panel assembly in an air conditioner, in accordance with some embodiments. FIG. 22 is a diagram showing a structure of a panel base in a panel assembly, in accordance with some embodiments.

In some embodiments, as shown in FIGS. 20 and 21, the panel assembly 30 includes a panel base 31, an air inlet grille 32 and a filtering member 33.

The indoor air inlet 22 and the indoor air outlet 23 are disposed on the panel base 31. The indoor air enters the indoor unit 40 from the indoor air inlet 22, and flows out from the indoor air outlet 23 after exchanging heat with the indoor heat exchanger 419. The air inlet grille 32 is located at the indoor air inlet 22, and the air inlet grille 32 is detachably connected to the panel base 31. The filtering member 33 is disposed on a surface (e.g., the rear surface)

of the air inlet grille 32 proximate to the indoor unit 40, and the filtering member 33 is clamped with the air inlet grille 32.

In some embodiments, as shown in FIGS. 20 to 22, the panel base 31 includes a panel body 310 and a second mounting groove 311. The second mounting groove 311 is disposed on a surface (e.g., the front surface) of the panel body 310 away from the indoor unit 40. For example, a part of the front surface of the panel body 310 is recessed toward the indoor unit 40, so as to form the second mounting groove 311, and a side of the second mounting groove 311 proximate to the base 10 is open.

For example, as shown in FIGS. 21 and 22, the second mounting groove 311 includes a first mounting sub-groove 3111, a second mounting sub-groove 3112 and a third mounting sub-groove 3113. The first mounting sub-groove 3111, the second mounting sub-groove 3112 and the third mounting sub-groove 3113 communicate with each other. The first mounting sub-groove 3111 and the third mounting sub-groove 3113 are respectively located on both sides (e.g., left and right sides) of the second mounting sub-groove 3112, and the second mounting sub-groove 3112 is proximate to the base 10. A side (e.g., the right side) of the first mounting sub-groove 3111 away from the indoor air inlet 22 is open, a side (e.g., the lower side) of the second mounting sub-groove 3112 away from the indoor air inlet 22 is open, and a side (e.g., the left side) of the third mounting sub-groove 3113 away from the indoor air inlet 22 is open.

The indoor air inlet 22 is disposed on the panel body 310, the air inlet grille 32 is installed in the second mounting groove 311, and a surface (e.g., the front surface) of the air inlet grille 32 away from the indoor unit 40 is substantially coplanar with the front surface of the panel body 310, so that the appearance of the air conditioner 1 is more beautiful.

Figure 23:
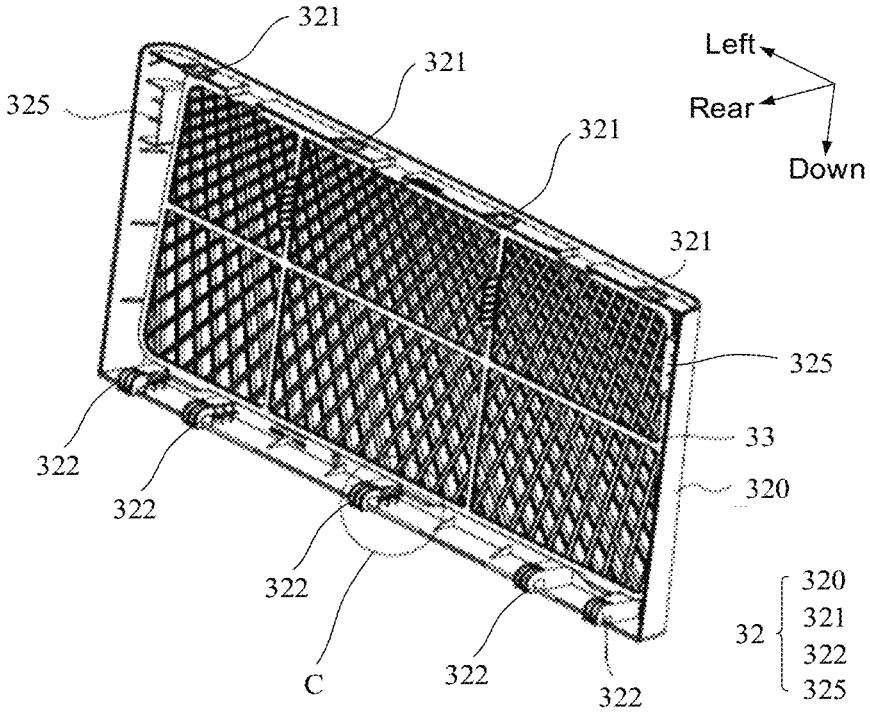
FIG. 23 is a diagram showing a structure of an air inlet grille in a panel assembly, in accordance with some embodiments.
Figure 24:
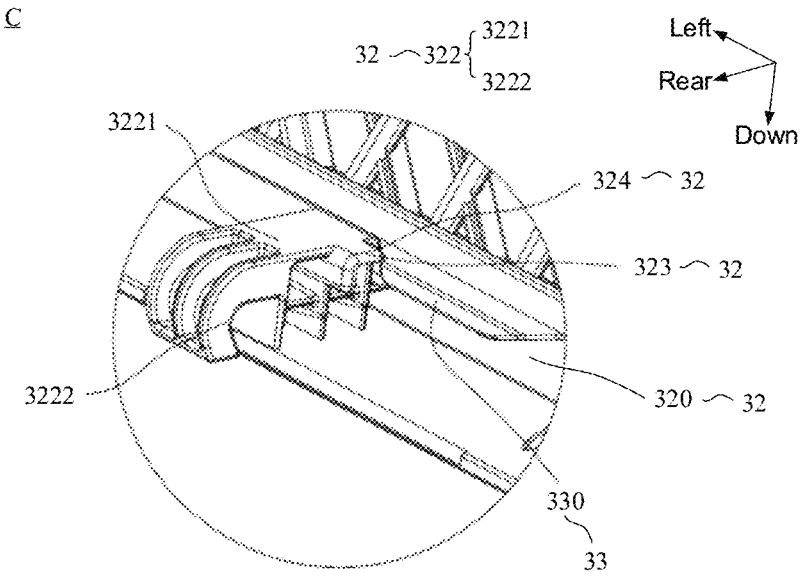
FIG. 24 is a partial enlarged view of the circle C in FIG. 23.

FIG. 23 is a diagram showing a structure of an air inlet grille in a panel assembly, in accordance with some embodiments. FIG. 24 is a partial enlarged view of the circle C in FIG. 23.

In some embodiments, as shown in FIGS. 23 and 24, the air inlet grille 32 includes a grille body 320, a plurality of first sub-buckles 321 and a plurality of second sub-buckles 322. The plurality of first sub-buckles 321 and the plurality of second sub-buckles 322 are respectively disposed on both sides of the grille body 320 in a height direction (e.g., the up-down direction). For example, the plurality of first sub-buckles 321 are disposed on a side (e.g., the upper side) of the grille body 320 away from the base 10, and are arranged in a length direction of the grille body 320 (e.g., the left-right direction) at intervals. The plurality of second sub-buckles 322 are disposed on a side (e.g., the lower side) of the grille body 320 proximate to the base 10, and are arranged in the length direction of the grille body 320 at intervals. The air inlet grille 32 may be clamped with the panel base 31 through the first sub-buckles 321 and the second sub-buckles 322, which facilitates the disassembly and assembly between the air inlet grille 32 and the panel base 31.

It will be noted that, the length direction of the grille body 320 is parallel to the width direction of the air conditioner 1.

Figure 25:
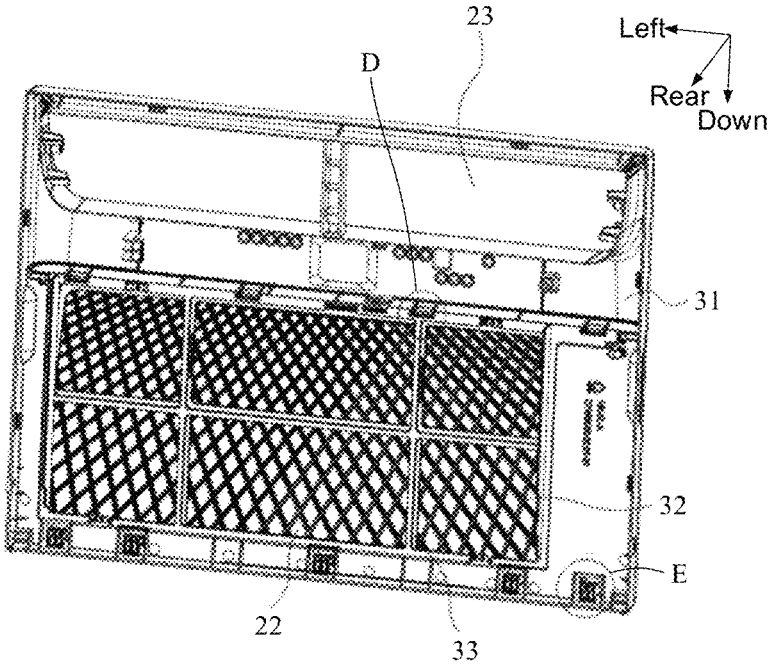
FIG. 25 is a diagram showing a structure of a panel base and an air inlet grille in a panel assembly, in accordance with some embodiments.
Figure 26:
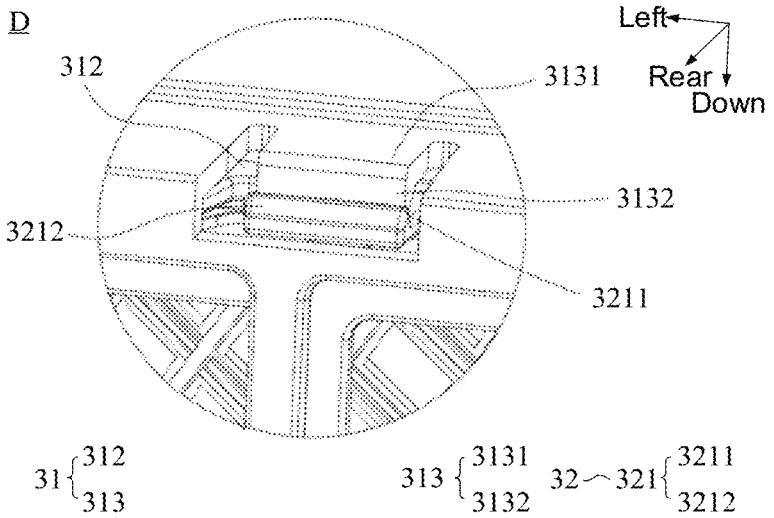
FIG. 26 is a partial enlarged view of the circle D in FIG. 25.
Figure 27:
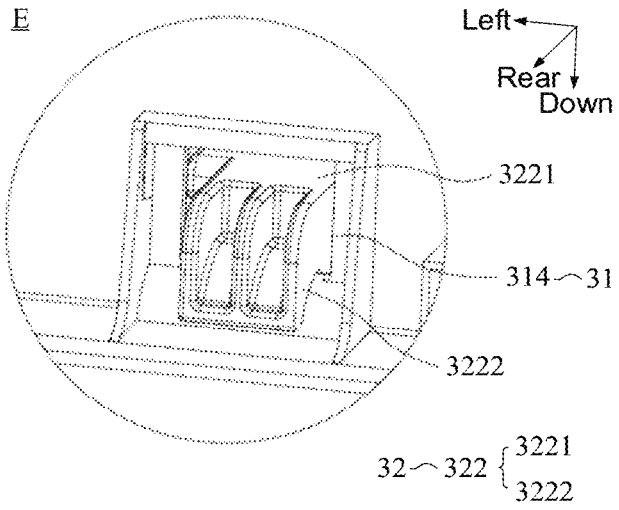
FIG. 27 is a partial enlarged view of the circle E in FIG. 25.

FIG. 25 is a diagram showing a structure of a panel base and an air inlet grille in a panel assembly, in accordance with some embodiments. FIG. 26 is a partial enlarged view of the circle D in FIG. 25. FIG. 27 is a partial enlarged view of the circle E in FIG. 25.

As shown in FIGS. 25 and 26, the first sub-buckle 321 includes a first sub-buckle body 3211 and a first clamping portion 3212. The first sub-buckle body 3211 is connected to the grille body 320. A first end of the first clamping portion 3212 is connected to the first sub-buckle body 3211, and a second end of the first clamping portion 3212 extends (e.g., upward) in a direction away from the base 10. The first sub-buckle 321 is clamped with the panel base 31.

For example, the panel base 31 includes a first clamping groove 312 and a third buckle 313. The first clamping groove 312 corresponds to the first sub-buckle 321, and the third buckle 313 is disposed in the first clamping groove 312. The third buckle 313 includes a third buckle body 3131 and a third clamping portion 3132. The third buckle body 3131 is connected to the panel base 31. A first end of the third clamping portion 3132 is connected to the third buckle body 3131, and a second end of the third clamping portion 3132 extends (e.g., downward) in a direction proximate to the base 10, and the second end of the third clamping portion 3132 is clamped with the first clamping portion 3212. The first sub-buckle 321 extends into the first clamping groove 312, and the first clamping portion 3212 is clamped with a side (e.g., the rear side) of the third clamping portion 3132 proximate to the indoor unit 40.

As shown in FIGS. 25 and 27, the second sub-buckle 322 includes a second sub-buckle body 3221 and a second clamping portion 3222. The second sub-buckle body 3221 is connected to the grille body 320. A first end of the second clamping portion 3222 is connected to the second sub-buckle body 3221, and a second end of the second clamping portion 3222 extends (e.g., downward) in a direction proximate to the base 10. The second sub-buckle 322 is clamped with the panel base 31.

For example, the panel base 31 includes a second clamping groove 314, and the second clamping groove 314 corresponds to the second sub-buckle 322. The second clamping portion 3222 is an arc-shaped hook. In this way, in a case where the second sub-buckle 322 extends into the second clamping groove 314, the arc-shaped hook may be hooked on an edge (e.g., the lower edge) of the second clamping groove 314 proximate to the base 10, and may rotate around the lower edge of the second clamping groove 314.

Based on the above structure, a mounting process of the air inlet grille 32 is as follows.

First, a lower portion of the air inlet grille 32 is moved to be close to the panel base 31, so that the second sub-buckle 322 of the air inlet grille 32 is inserted into the second clamping groove 314 of the panel base 31. Then, the air inlet grille 32 is rotated around the lower edge of the second clamping groove 314, so that an upper portion of the air inlet grille 32 is made to approach the panel base 31 until the first sub-buckle 321 of the air inlet grille 32 extends into the first clamping groove 312. Then the upper portion of the air inlet grille 32 is pushed, and the first clamping portion 3212 is clamped with the rear side of the third clamping portion 3132, so that the air inlet grille 32 is fixedly installed on the panel base 31. In a case where the air inlet grille 32 needs to be disassembled, the first sub-buckle 321 are pressed downward from the rear surface of the panel base 31, so as to disengage the first clamping portion 3212 from the third clamping portion 3132. Then, the air inlet grille 32 is rotated around the lower edge of the second clamping groove 314, so that the top portion of the air inlet grille 32 is away from the panel base 31. Finally, the second sub-buckle 322 is pulled out from the second clamping groove 314, so that the disassembly of the air inlet grille 32 is completed.

In some embodiments of the present disclosure, the air inlet grille 32 is installed on the panel base 31 through the above structure, so that the disassembly and assembly of the air inlet grille 32 is easy, and the installed panel assembly 30 has good stability.

In some embodiments, as shown in FIGS. 23 and 24, the air inlet grille 32 further includes a plurality of limiting portions 323 and a plurality of insertion grooves 324. First parts of the plurality of limiting portions 323 are respectively disposed on sides of the first sub-buckle bodies 3211, and second parts of the plurality of limiting portions 323 are respectively disposed on sides of the second sub-buckle bodies 3221. The plurality of limiting portions 323 are arranged at an interval with the grille body 320, so as to form the insertion grooves 324 disposed between the limiting portions 323 and a surface (e.g., the rear surface) of the grille body 320 proximate to the indoor unit 40. A side of the insertion groove 324 facing at least one of the first sub-buckle body 3211 or the second sub-buckle body 3221 is open, so as to form an opening. In this way, an edge of the filtering member 33 may be inserted into the insertion groove 324 through the opening, and plugged with the insertion groove 324, so that the assembly between the filtering member 33 and the air inlet grille 32 is realized.

For example, as shown in FIG. 21, the filtering member 33 includes a bracket 331, a filter mesh 332 and an inserting portion 330. The filter mesh 332 is disposed on the bracket 331 to filter impurities in the indoor air. The inserting portion 330 is disposed on an edge of the bracket 331, and the inserting portion 330 is plugged with the insertion groove 324. As shown in FIG. 24, the inserting portion 330 is inserted into the insertion groove 324, so as to install the filtering member 33 on the air inlet grille 32.

Through sliding or pulling the inserting portion 330, the inserting portion 330 may be plugged with the insertion groove 324 or disengaged from the insertion groove 324, which facilitates the assembly and disassembly between the filtering member 33 and the air inlet grille 32.

In some embodiments, as shown in FIG. 21, the filtering member 33 includes a plurality of inserting portions 330. The plurality of inserting portions 330 are spaced along an outer circumference of the bracket 331 and correspond to the insertion grooves 324.

In some embodiments, the limiting portion 323 and the first sub-buckle 321 are an integral member, or, the limiting portion 323 and the second sub-buckle 322 are an integral member.

In some embodiments, as shown in FIG. 23, the air inlet grille 32 further includes a second plug-in connector 325. For example, the air inlet grille 32 includes a plurality of second plug-in connectors 325, and the plurality of second plug-in connectors 325 are respectively disposed on both sides (e.g., the left and right sides) of the grille body 320 in the length direction. As shown in FIG. 22, the panel base 31 further includes a first plug-in connector 315. For example, the panel base 31 includes a plurality of first plug-in connectors 315, and the plurality of first plug-in connectors 315 are disposed at a groove bottom of the second mounting groove 311 and matched with the second plug-in connectors 325. The first plug-in connectors 315 are plugged with the second plug-in connectors 325 for pre-positioning the panel base 31 and the air inlet grille 32 during the installation process thereof.

In some embodiments of the present disclosure, the filtering member 33 is clamped with the rear surface of the air inlet grille 32, and the air inlet grille 32 is detachably connected to the indoor air inlet 22 of the panel base 31, which is convenient for the disassembly and assembly and cleaning of the air inlet grille 32 and the filtering member 33. In this way, in a case where the air inlet grille 32 and the filtering member 33 need to be cleaned, the air inlet grille 32 together with the filtering member 33 may be removed from the panel base 31. Moreover, after flushing, the air inlet grille 32 together with the filtering member 33 may be connected to the panel base 31. In addition, in a case where the air inlet grille 32 and the filtering member 33 need to be cleaned independently, the filtering member 33 may be removed from the air inlet grille 32, and then the air inlet grille 32 and the filtering member 33 each may be cleaned.

Second Temperature Sensor and Third Mounting Base

Figure 28:
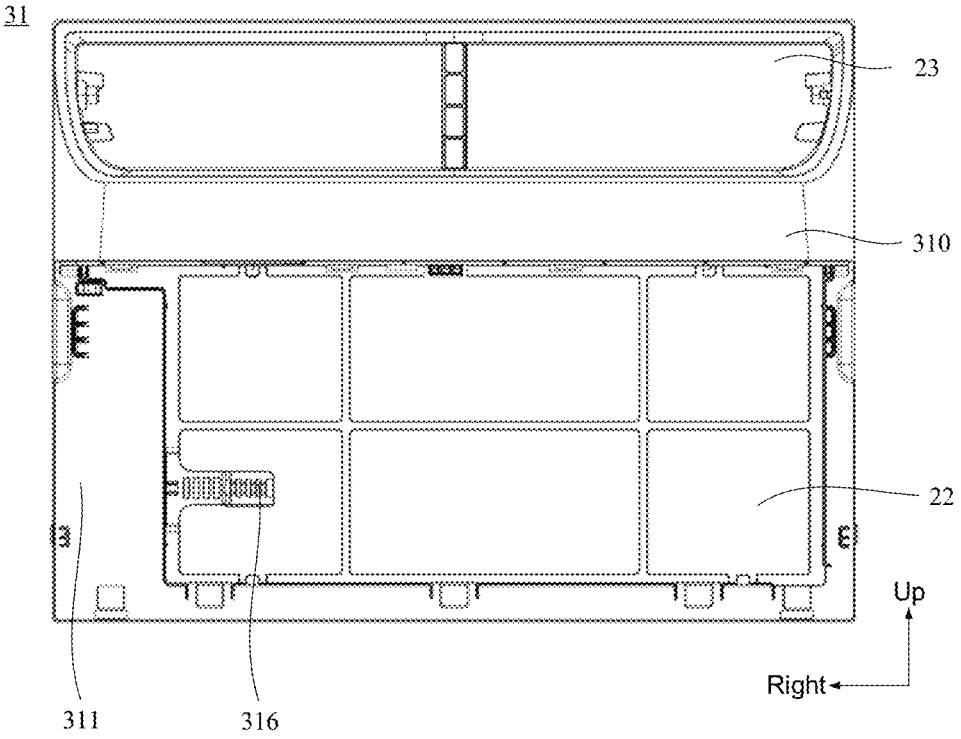
FIG. 28 is a front view of another panel base in a panel assembly, in accordance with some embodiments.
Figure 29:
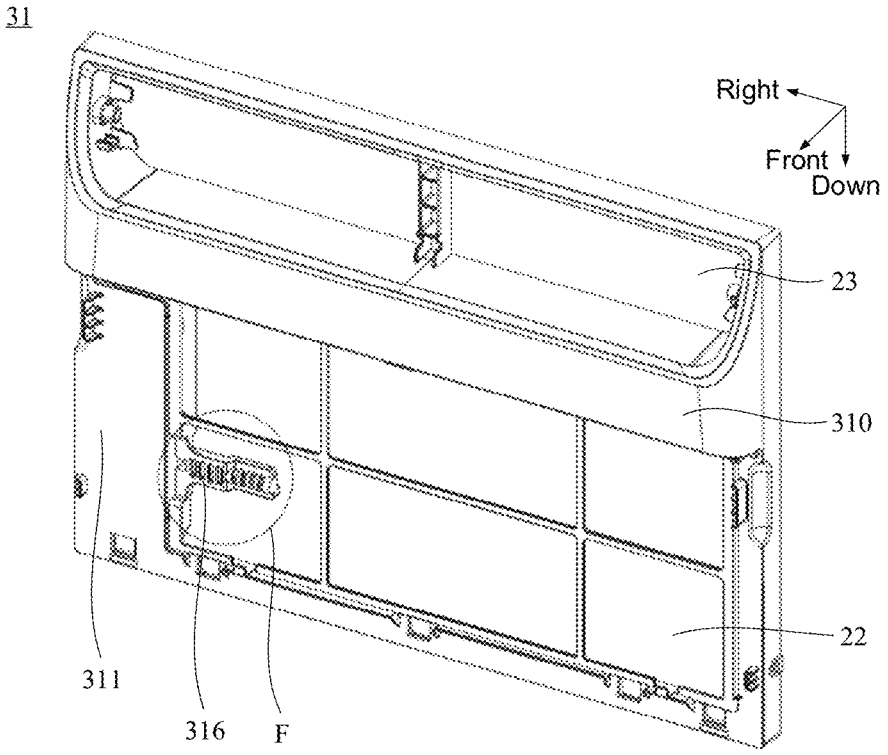
FIG. 29 is a diagram showing a structure of another panel base in a panel assembly, in accordance with some embodiments.
Figure 30:
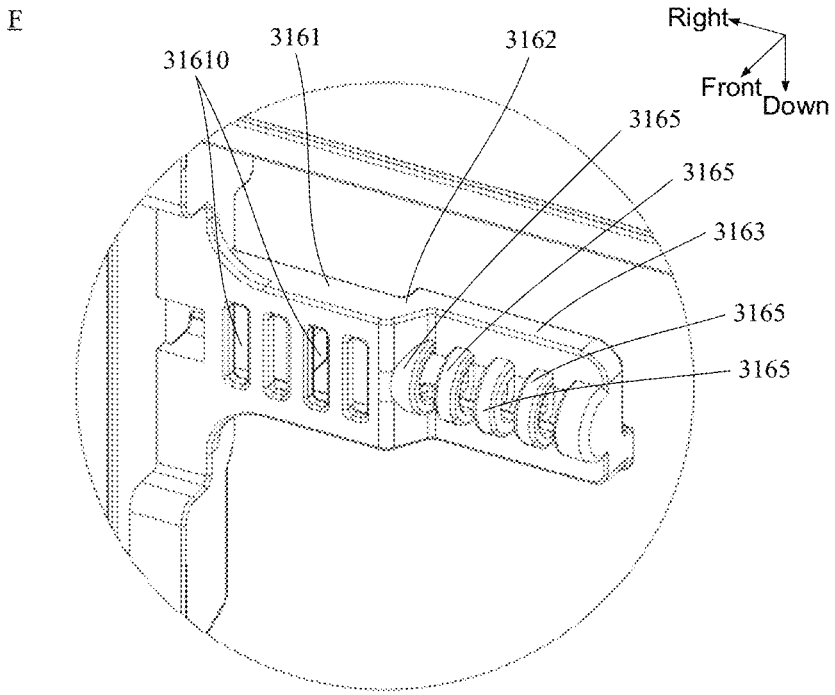
FIG. 30 is a partial enlarged view of the circle F in FIG. 29.
Figure 31:
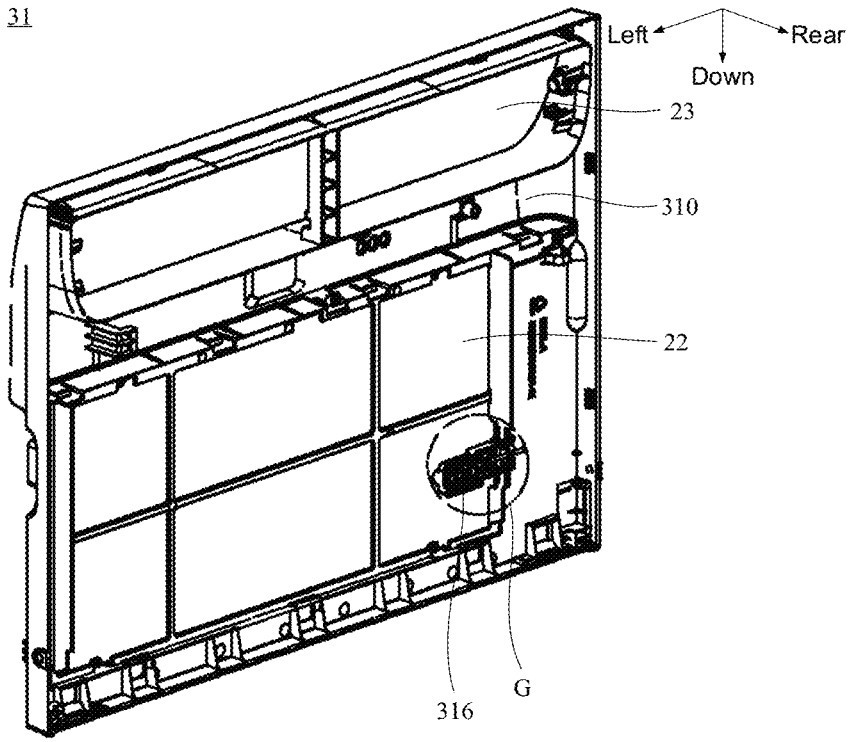
FIG. 31 is another diagram showing a structure of another panel base, in accordance with some embodiments.
Figure 32:
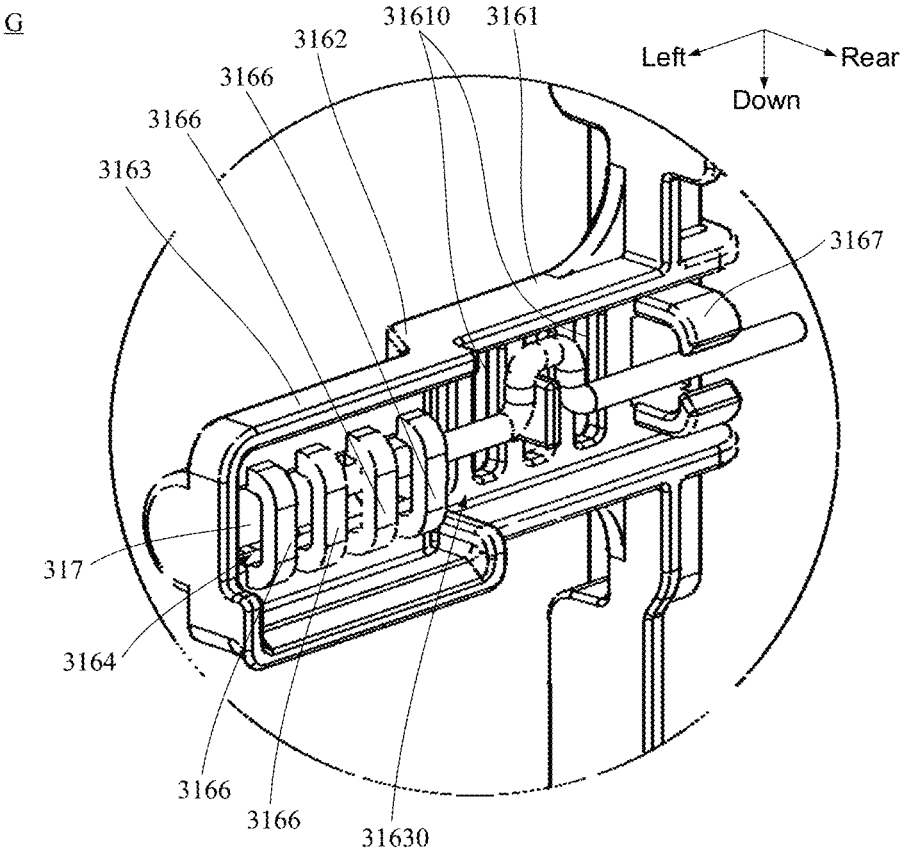
FIG. 32 is a partial enlarged view of the circle G in FIG. 31.

FIG. 28 is a front view of another panel base in a panel assembly, in accordance with some embodiments. FIG. 29 is a diagram showing a structure of another panel base in a panel assembly, in accordance with some embodiments. FIG. 30 is a partial enlarged view of the circle F in FIG. 29. FIG. 31 is another diagram showing a structure of another panel base, in accordance with some embodiments. FIG. 32 is a partial enlarged view of the circle G in FIG. 31.

In some embodiments, as shown in FIGS. 28 and 29, the panel base 31 further includes a third mounting base 316 and a second temperature sensor 317 (as shown in FIG. 32). The third mounting base 316 is disposed on an edge (e.g., the right edge or the upper edge) of an opening of the indoor air inlet 22. The second temperature sensor 317 is configured to detect a temperature of the indoor air. The third mounting base 316 is disposed in the middle of an edge of the indoor air inlet 22, so that a flow rate of the indoor air passing through the third mounting base 316 is large, and the temperature of the indoor air may be monitored.

In some embodiments, as shown in FIG. 29, the third mounting base 316 is located on a side (e.g., the front side) of the panel body 310 away from the indoor unit 40, and at least a part of the third mounting base 316 is bent toward (e.g., backward) the indoor unit 40, and the at least the part of the third mounting base 316 passes through the indoor air inlet 22, so that the at least the part of the third mounting base 316 is located on a side (e.g., the rear side) of the panel body 310 proximate to the indoor unit 40.

For example, as shown in FIGS. 30 to 32, the third mounting base 316 includes a fixing portion 3161, a curved portion 3162 and a third mounting portion 3163. The fixing portion 3161, the curved portion 3162 and the third mounting portion 3163 are connected in sequence. The fixing portion 3161 is located on the front side of the panel body 310, and the fixing portion 3161 is detachably disposed on the edge of the opening of the indoor air inlet 22. The curved portion 3162 is located between the fixing portion 3161 and the third mounting portion 3163, and the third mounting portion 3163 is located on the rear side of the panel body 310 and is connected to the fixing portion 3161 through the curved portion 3162.

In some embodiments, as shown in FIG. 30, a portion of the fixing portion 3161 extends toward the middle of the indoor air inlet 22, so as to cross a part of the indoor air inlet 22. Moreover, the third mounting base 316 further includes a through hole 31610 (e.g., a strip-shaped hole), the through hole 31610 is disposed on the fixing portion 3161 and runs through the fixing portion 3161 in a thickness direction (e.g., the front-rear direction), so that the indoor air may pass through the fixing portion 3161 through the through hole 31610, and the pressure of the indoor air at the fixing portion 3161 may be reduced, and the service life of the third mounting base 316 may be prolonged.

In some embodiments, as shown in FIG. 32, the third mounting base 316 includes a fourth buckle 3167. The fourth buckle 3167 is disposed on a side (e.g., the rear side) of the fixing portion 3161 proximate to the indoor unit 40. The fourth buckle 3167 is configured to fix a wire of the second temperature sensor 317.

In some embodiments, the third mounting base 316 and the panel body 310 are an integral member, and the third mounting base 316 is made of plastic. In this way, it is convenient to preset the third mounting base 316 on the panel body 310, and the overall structure has high strength, light weight, and low cost. Of course, the third mounting base 316 may also be made of a metal material.

Figure 33:
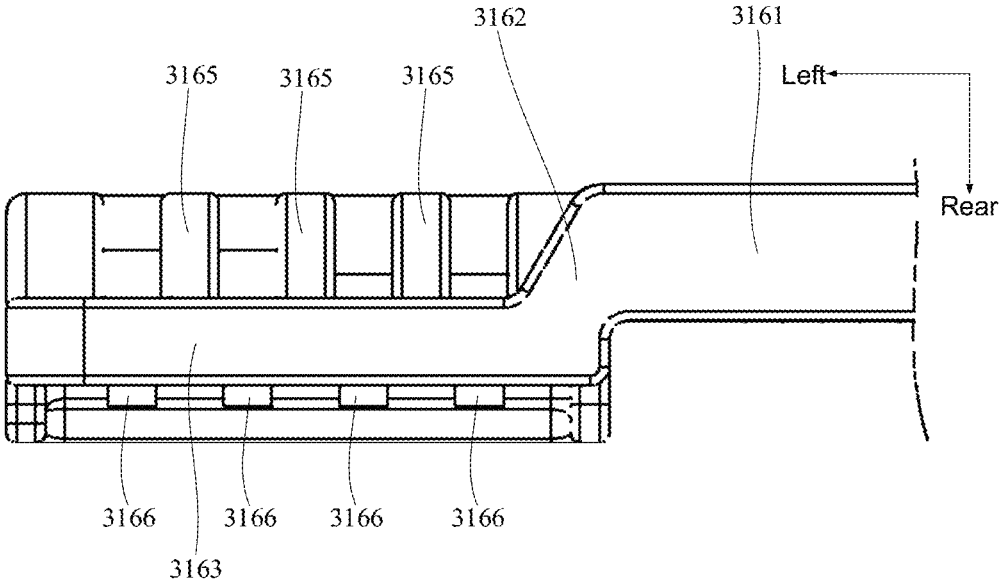
FIG. 33 is a diagram showing a structure of a third mounting base in a panel assembly, in accordance with some embodiments.

In some embodiments, as shown in FIGS. 30 and 32, the third mounting base 316 includes a mounting passage 3164, a plurality of first fixing members 3165 and a plurality of second fixing members 3166. FIG. 33 is a diagram showing a structure of a third mounting base in a panel assembly, in accordance with some embodiments. As shown in FIG. 33, the plurality of first fixing members 3165 and the plurality of second fixing members 3166 are alternately arranged in a length direction (e.g., the left-right direction as shown in FIG. 33) of the third mounting base 316.

It will be noted that, the length direction of the third mounting base 316 is parallel to the width direction of the air conditioner 1.

The plurality of first fixing members 3165 are disposed on a side (e.g., the front side) of the third mounting portion 3163 away from the indoor unit 40, and the plurality of first fixing members 3165 are arranged in an extending direction (e.g., the left-right direction) of the third mounting portion 3163 at intervals. For example, as shown in FIG. 30, a part of a surface (e.g., the front surface) of the third mounting portion 3163 away from the indoor unit 40 protrudes in a direction (e.g., from the rear to the front) away from the indoor unit 40, so as to form the plurality of first fixing members 3165 arranged at intervals.

The plurality of second fixing members 3166 are disposed on a side (e.g., the rear side) of the third mounting portion 3163 proximate to the indoor unit 40, and the plurality of second fixing members 3166 are arranged in the extending direction of the third mounting portion 3163 at intervals. For example, as shown in FIG. 32, a part of a surface (e.g., the rear surface) of the third mounting portion 3163 proximate to the indoor unit 40 protrudes in a direction (e.g., from the front to the rear) proximate to the indoor unit 40, so as to form the plurality of second fixing members 3166 arranged at intervals.

A region of the third mounting portion 3163 located between the plurality of first fixing members 3165 and the plurality of second fixing members 3166 is hollow, so as to form the mounting passage 3164. The mounting passage 3164 is configured to fix the second temperature sensor 317. For example, the second temperature sensor 317 is inserted into the mounting passage 3164.

Since the plurality of first fixing members 3165 and the plurality of second fixing members 3166 are alternately arranged, the second temperature sensor 317 disposed in the mounting passage 3164 alternately contacts the first fixing members 3165 and the second fixing members 3166. In this way, after passing through the gaps between the plurality of first fixing members 3165 into the mounting passage 3164, the indoor air may flow out through the gaps between the plurality of second fixing members 3166, and the indoor air receives small resistance, so that the indoor air may flow smoothly through the mounting passage 3164.

In some embodiments, as shown in FIGS. 31 and 32, the third mounting base 316 includes a notch 31630. The notch 31630 is disposed at a connecting position between the curved portion 3162 and the third mounting portion 3163, and the notch 31630 communicates with the mounting passage 3164. In this way, the second temperature sensor 317 may be inserted into the mounting passage 3164 through the notch 31630, which is convenient to install the second temperature sensor 317.

In some embodiments, the first fixing member 3165 and the second fixing member 3166 each are formed in an arc shape, so that the cross section of the mounting passage 3164 is substantially circular, which is convenient to install the second temperature sensor 317.

In some embodiments of the present disclosure, the second temperature sensor 317 is inserted in the mounting passage 3164, and the indoor air needs to pass through the panel base 31 before entering the indoor unit 40, and the indoor air needs to enter the indoor unit 40 through the indoor air inlet 22. During such process, the indoor air enters the mounting passage 3164 from the gaps between the plurality of first fixing members 3165, and contacts the second temperature sensor 317 in the mounting passage 3164, so that the second temperature sensor 317 may detect the temperature of the indoor air. Afterwards, the indoor air flows out from the mounting passage 3164 through the gaps between the plurality of second fixing members 3166.

By providing the plurality of first fixing members 3165 and the plurality of second fixing members 3166 arranged alternately, it is possible to stably install the second temperature sensor 317, and provide a space for the indoor air to pass through the mounting passage 3164, and avoid blocking the flow of the indoor air. In addition, through pre-installing the second temperature sensor 317 on the panel base 31, it is possible to save the time for assembling the panel base 31, and improve the production efficiency.

A person skilled in the art will understand that, the scope of disclosure in the present disclosure is not limited to specific embodiments discussed above, and may modify and substitute some elements of the embodiments without departing from the spirits of this application. The scope of this application is limited by the appended claims.

What is claimed is:

1. An air conditioner, comprising:

a base;

a housing disposed on the base, an accommodating space being provided between the housing and the base;

an indoor unit located in the accommodating space;

an outdoor unit located in the accommodating space and arranged at an interval with the indoor unit; wherein at least one of sides of the indoor unit and the outdoor unit proximate to each other is provided with a groove;

an electrical control assembly installed between the indoor unit and the outdoor unit, at least a part of the electrical control assembly being installed in the groove; and a mounting frame, disposed between the outdoor unit and the indoor unit, the mounting frame comprising a mounting frame body and a connecting frame connected to the mounting frame body;

wherein the electrical control assembly comprises:

an electrical box comprising a cover and an accommodating portion, wherein the cover covers the accommodating portion to form an internal space for accommodating a controller, and each of the cover and the accommodating portion has a connecting portion on a side corresponding to the groove, wherein the connecting portion of the cover and the connecting portion of the accommodating portion extend to the groove and are connected to the groove; and the controller disposed in the electrical box;

wherein the electrical control assembly further comprises a first mounting base disposed on a bottom surface of the accommodating portion toward the base and connected to the connecting frame.

2. The air conditioner according to claim 1, wherein the accommodating portion comprises a box body and a protective cover disposed on a side of the box body, wherein at least one of the box body and the protective cover has the connecting portion.

3. The air conditioner according to claim 1, wherein the cover comprises at least two connecting portions spaced apart on the same side, wherein the at least two connecting portions of the cover are connected to the connecting portion of the accommodating portion.

4. The air conditioner according to claim 1, wherein the groove is located on a side of the outdoor unit and faces the indoor unit, and the connecting portion of the cover and the connecting portion of the accommodating portion both extend to the outdoor unit.

5. The air conditioner according to claim 1, wherein the groove is located on a side of the indoor unit and faces the outdoor unit, and the connecting portion of the cover and the connecting portion of the accommodating portion both extend toward the indoor unit.

6. The air conditioner according to claim 1, wherein the indoor unit comprises an indoor air duct component, and the outdoor unit comprises an outdoor air duct component, wherein a part of a side of the indoor air duct component facing the outdoor unit is configured as a mounting space, and the mounting space is recessed inwardly to form the groove, or wherein a part of a side of the outdoor air duct component facing the indoor unit is configured as a mounting space, and the mounting space is recessed inwardly to form the groove.

7. The air conditioner according to claim 1, wherein the groove is open on the side facing the electrical control assembly to form an opening, and the connecting portion enters and is accommodated in the groove through the opening.

8. The air conditioner according to claim 1, wherein both the sides of the indoor unit and the outdoor unit facing each other are provided with grooves, the grooves comprise a first groove and a second groove:

wherein the first groove is provided on a side of the indoor unit facing the outdoor unit;

wherein the second groove is provided on a side of the outdoor unit facing the indoor unit;

wherein the electrical box comprises connecting portions on both sides, the connecting portion on a side of the electrical box facing the indoor unit is a first connecting portion, and the connecting portion on the side of the electrical box facing the outdoor unit is a second connecting portion, wherein the first connecting portion is connected to the first groove, the second connecting portion is connected to the second groove.

9. The air conditioner according to claim 1, wherein the connection between the first mounting base and the connecting frame is a snap-fit connection.

10. The air conditioner according to claim 9, wherein two first buckles are respectively disposed on two opposite inner side walls of a connecting groove, wherein the two first buckles are configured to snap-fit with a part of a plug-in portion.

11. The air conditioner according to claim 1, wherein the mounting frame body is provided with a frame for mounting a fan assembly, wherein the connecting frame is located on a side of the frame away from the base and extends toward the electrical control assembly.

12. Air conditioner according to claim 1, wherein the mounting frame further comprises a mounting sub-portion disposed at an end of the connecting frame close to the electrical control assembly, wherein one of the mounting sub-portion and the first mounting base comprises a connecting groove, and the other comprises a plug-in portion, wherein the plug-in portion is inserted into and snap-fitted with the connecting groove.

13. The air conditioner according to claim 12, wherein the plug-in portion and the connecting groove are snap-fitted in a direction perpendicular to a length direction of the electrical control assembly.

14. The air conditioner according to claim 12, wherein the first mounting base comprises the connecting groove, and the mounting sub-portion comprises the plug-in portion;

wherein the first mounting base further comprises a mounting base body and a mounting hole provided on the mounting base body, the plug-in portion of the mounting sub-portion is inserted into the connecting groove, the mounting hole corresponds to the mounting sub-portion, and a connecting member passes through the mounting hole and is fixedly connected to the mounting sub-portion.

15. The air conditioner according to claim 12, wherein the mounting sub-portion comprises the connecting groove, and the first mounting base comprises the plug-in portion;

wherein the first mounting base is snap-fitted with the connecting groove of the mounting sub-portion through the plug-in portion.

16. The air conditioner according to claim 12, wherein an external shape of the plug-in portion matches a shape of the connecting groove enclosed, wherein when the plug-in portion is inserted into the connecting groove, an external surface of the plug-in portion is in contact with an inner wall of the connecting groove.

17. The air conditioner according to claim 1, wherein the accommodating portion comprises a box body and a protective cover disposed on a side of the box body, wherein the first mounting base protrudes from a side of the protective cover proximate to the mounting frame.

18. The air conditioner according to claim 17, wherein the first mounting base is installed on the protective cover.

19. The air conditioner according to claim 17, wherein the first mounting base is installed on the box body, and the protective cover is provided with a through-hole through which the first mounting base extends toward the connecting frame.

20. The air conditioner according to claim 1, wherein an end of the connecting frame away from the base abuts against a side of the electrical control assembly proximate to the base.

21. The air conditioner according to claim 1, wherein the first mounting base of the electrical control assembly is connected to the connecting frame of the mounting frame in a direction perpendicular to a length direction of the electrical control assembly, and wherein the connecting portion of the electrical control assembly is connected to the groove provided on at least one of the indoor unit and the outdoor unit in the length direction of the electrical control assembly.

* * * * *